US011045700B2

(12) United States Patent
Adams et al.

(10) Patent No.: US 11,045,700 B2
(45) **Date of Patent: *Jun. 29, 2021**

(54) GOLF SHAFT

(71) Applicant: Breakthrough Golf Technology LLC, Dallas, TX (US)

(72) Inventors: Byron H. Adams, Indian Wells, CA (US); Blair M. Philip, Dallas, TX (US); Jeffrey T. Halstead, Wylie, TX (US); Robert E. Stephens, Fort Worth, TX (US); Trever M. Napier, Plano, TX (US); James P. MacKay, Littleton, MA (US)

(73) Assignee: BREAKTHROUGH GOLF TECHNOLOGY, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/983,009

(22) Filed: Aug. 3, 2020

(65) Prior Publication Data

US 2021/0001192 A1 Jan. 7, 2021

Related U.S. Application Data

(63) Continuation of application No. 16/237,894, filed on Jan. 2, 2019, now Pat. No. 10,729,952, which is a continuation of application No. 15/884,683, filed on Jan. 31, 2018, now Pat. No. 10,213,666.

(51) Int. Cl.

| | |
|---|---|
| ***A63B 53/10*** | (2015.01) |
| ***A63B 53/12*** | (2015.01) |
| ***A63B 53/00*** | (2015.01) |
| ***A63B 60/08*** | (2015.01) |
| ***A63B 60/26*** | (2015.01) |

(52) U.S. Cl.

CPC ..... *A63B 53/10* (2013.01); *A63B 53/007* (2013.01); *A63B 53/12* (2013.01); *A63B 60/08* (2015.10); *A63B 60/26* (2015.10)

(58) Field of Classification Search

CPC ..... A63B 53/10; A63B 60/08; A63B 60/26; A63B 53/12; A63B 53/007

See application file for complete search history.

(56) References Cited

U.S. PATENT DOCUMENTS

| | | | |
|---|---|---|---|
| 782,955 | A | 2/1905 | Emens |
| 1,312,485 | A | 8/1917 | Krauth |
| 1,426,202 | A | 8/1922 | Lard |
| 1,623,523 | A | 4/1927 | Bourke |
| 1,792,852 | A | 2/1931 | Mattern |

(Continued)

FOREIGN PATENT DOCUMENTS

| | | |
|---|---|---|
| JP | 4142181 | 8/2008 |
| KR | 300828979 | 12/2015 |

OTHER PUBLICATIONS

Northwestern Golf Driver with Power Kick Shaft from the 1980s.

(Continued)

*Primary Examiner* — Stephen L Blau

(74) *Attorney, Agent, or Firm* — Dawsey Co., LPA; David J. Dawsey

(57) ABSTRACT

A multi-material golf shaft having a butt portion joined to a tip portion and possessing unique relationships, including rigidity relationships, which provide beneficial performance characteristics.

20 Claims, 11 Drawing Sheets

(56) References Cited

U.S. PATENT DOCUMENTS 1,802,507 A 4/1931 Hadden
1,844,812 A 2/1932 Thorpe
1,994,069 A 3/1935 Fletcher
2,085,915 A 7/1937 MacCallum
2,150,737 A 3/1939 Chittick
2,367,196 A 1/1945 Butler
2,455,525 A 12/1948 Schulz
2,473,351 A 6/1949 Thompson
2,599,222 A 6/1952 Bergqvist
2,643,143 A 6/1953 Bergqvist
2,658,777 A 11/1953 Rauglas
2,787,485 A 4/1957 Frisell
2,842,387 A 7/1958 Della-Porta
2,884,270 A 4/1959 Carlberg
2,980,456 A 4/1961 McMullin
3,161,395 A 12/1964 Carter
3,245,703 A 4/1966 Manly
3,265,401 A 8/1966 Spier
3,326,580 A 6/1967 Munier et al.
3,335,735 A 8/1967 Colegrove et al.
3,379,460 A 4/1968 Allyn
3,461,593 A 8/1969 Martuch
3,603,623 A 9/1971 Widman
3,826,523 A 7/1974 Eschbaugh
3,829,092 A 8/1974 Arkin
3,848,737 A 11/1974 Kenon
3,953,138 A 4/1976 Hine et al.
4,036,515 A 7/1977 Karcher et al.
4,085,763 A 4/1978 Thomas
4,123,055 A 10/1978 Brill
D250,356 S 11/1978 Kaugars
4,127,764 A 11/1978 Minden
4,253,666 A 3/1981 Murphy
4,294,560 A 10/1981 Larkin
4,304,426 A 12/1981 Francis
D263,330 S 3/1982 Kaugars et al.
4,374,315 A 2/1983 Timbrook
4,376,525 A 3/1983 Fremy
4,401,326 A 8/1983 Blair
4,419,026 A 12/1983 Leto
4,462,622 A 7/1984 Barzuza
4,596,484 A 6/1986 Nakatani
4,597,577 A 7/1986 Fixler
4,601,497 A 7/1986 Bartholomew
4,681,351 A 7/1987 Bartholomew
4,691,943 A 9/1987 DeLand et al.
4,733,681 A 3/1988 Lee
4,750,765 A 6/1988 Cassidy et al.
4,761,092 A 8/1988 Nakatani
4,775,172 A 10/1988 Sauer
4,778,203 A 10/1988 Bartholomew
4,793,637 A 12/1988 Laipply et al.
4,836,545 A * 6/1989 Pompa ..... A63B 53/10 473/320
4,850,622 A 7/1989 Suzuki
4,852,782 A 8/1989 Huang
4,872,710 A 10/1989 Konecny et al.
4,895,368 A 1/1990 Geiger
4,895,396 A 1/1990 Washizu
5,018,735 A 5/1991 Meredith et al.
5,080,519 A 1/1992 Chi
5,083,779 A 1/1992 Ungermann
5,083,780 A 1/1992 Walton et al.
5,112,084 A 5/1992 Washizu
5,138,911 A 8/1992 Lan
5,226,652 A 7/1993 Sato
5,253,867 A 10/1993 Gafner
5,286,129 A 2/1994 French et al.
5,297,823 A 3/1994 Dubost
5,328,174 A 7/1994 Reeder
5,356,235 A 10/1994 Brown
5,394,770 A 3/1995 Boike et al.
5,433,442 A 7/1995 Walker
5,439,219 A 8/1995 Vincent
5,447,306 A 9/1995 Selden
5,496,074 A 3/1996 Viratelle et al.
5,513,844 A 5/1996 Ashcraft
5,547,189 A 8/1996 Billings
5,575,473 A 11/1996 Turner
5,588,766 A 12/1996 Lai
5,607,173 A 3/1997 Lai
D378,771 S 4/1997 Antonious
D380,802 S 7/1997 Franks
D385,608 S 10/1997 Hoffmeyer
D385,934 S 11/1997 You
5,692,971 A 12/1997 Williams
5,718,463 A 2/1998 Hollnagel
5,722,697 A 3/1998 Waterson
5,722,901 A 3/1998 Barron
5,749,606 A 5/1998 Lu et al.
5,758,909 A 6/1998 Dole et al.
5,759,113 A 6/1998 Lai et al.
5,765,877 A 6/1998 Sakane et al.
5,775,352 A 7/1998 Obitts
5,779,277 A 7/1998 Street
5,788,586 A 8/1998 Macioce
5,792,006 A 8/1998 Hesser
5,803,512 A 9/1998 Hollnagel
5,806,898 A 9/1998 Hollnagle
5,868,438 A 2/1999 Svetlik
5,887,911 A 3/1999 Kargula
5,904,627 A 5/1999 Miyaji et al.
5,913,733 A 6/1999 Bamber
5,930,872 A 8/1999 McBride et al.
5,935,017 A 8/1999 Weaver et al.
5,947,839 A 9/1999 Kusumoto
5,988,706 A 11/1999 Hollnagle
5,997,412 A 12/1999 Benson
6,022,053 A 2/2000 Hukuda
D430,248 S 8/2000 Adams et al.
D430,249 S 8/2000 Burger
6,113,508 A 9/2000 Locarno et al.
6,117,021 A 9/2000 Crow et al.
6,139,444 A 10/2000 Renard et al.
6,203,447 B1 3/2001 Dillard
D444,526 S 7/2001 Adams et al.
6,257,993 B1 7/2001 Morell et al.
6,257,997 B1 7/2001 Doble et al.
6,273,830 B1 8/2001 Takemura et al.
6,302,806 B1 10/2001 Hsu
6,343,999 B1 2/2002 Murtland et al.
6,361,451 B1 3/2002 Masters et al.
6,485,376 B1 11/2002 Hisamatsu
D466,575 S 12/2002 Hedrick et al.
6,532,818 B2 3/2003 Blankenship
6,547,673 B2 4/2003 Roark
6,561,922 B2 5/2003 Bamber
6,582,320 B2 6/2003 Fendel
6,705,954 B2 3/2004 Takiguchi et al.
6,729,970 B2 5/2004 Horwood et al.
6,743,116 B2 6/2004 Wilbur
6,764,414 B2 7/2004 Kumamoto
6,793,590 B1 9/2004 Ho
D499,459 S 12/2004 Chiasson
D501,904 S 2/2005 Ferris
6,860,821 B2 3/2005 Unosawa et al.
D504,166 S 4/2005 Bellefleur et al.
6,890,269 B2 5/2005 Burrows
6,902,495 B2 6/2005 Pergande et al.
D507,815 S 7/2005 Hedrick et al.
RE38,983 E 2/2006 Antonious
D517,145 S 3/2006 Bonar et al.
7,070,512 B2 7/2006 Nishio
D529,973 S 10/2006 Brookshire-Herr
7,115,045 B2 10/2006 Horwood et al.
7,128,659 B1 10/2006 Lee
7,140,398 B2 11/2006 Dodge et al.
D537,498 S 2/2007 Brookshire-Herron
7,226,365 B2 6/2007 Qualizza
7,252,598 B2 8/2007 Lindner
7,297,070 B2 11/2007 Ashida et al.
7,300,360 B2 11/2007 Oyama
7,318,780 B2 1/2008 Oyama
7,347,791 B1 3/2008 Watkins et al.

(56) References Cited

U.S. PATENT DOCUMENTS

| | | | |
|---|---|---|---|
| 7,427,240 | B2 | 9/2008 | Takeuchi |
| 7,435,187 | B2 | 10/2008 | Stites et al. |
| 7,524,248 | B2 | 4/2009 | Kumamoto |
| 7,789,770 | B1 | 9/2010 | Li |
| D641,820 | S | 7/2011 | Swist |
| 8,096,894 | B2 | 1/2012 | Sander |
| 8,117,942 | B2 | 2/2012 | Kuwata et al. |
| 8,157,669 | B2 | 4/2012 | Hulock et al. |
| 8,182,360 | B2 | 5/2012 | Cameron |
| 8,192,298 | B2 | 6/2012 | Droppleman |
| D676,911 | S | 2/2013 | Brown, Jr. et al. |
| D686,289 | S | 7/2013 | Brown, Jr. et al. |
| 8,491,411 | B2 | 7/2013 | DeShiell et al. |
| 8,517,857 | B2 | 8/2013 | Wakabayashi et al. |
| D699,801 | S | 2/2014 | Ito et al. |
| 8,641,551 | B2 | 2/2014 | Johnson |
| 8,777,772 | B2 | 7/2014 | Hasegawa et al. |
| 8,827,828 | B2 | 9/2014 | Brekke et al. |
| 8,845,452 | B2 | 9/2014 | Sato |
| 8,852,022 | B2 | 10/2014 | DeShiell et al. |
| D717,895 | S | 11/2014 | Cynn |
| 8,936,516 | B2 | 1/2015 | Yashiki |
| D732,619 | S | 6/2015 | Henrikson et al. |
| 9,050,511 | B2 | 6/2015 | Hicks |
| 9,295,888 | B2 | 3/2016 | Fujiwara et al. |
| D772,362 | S | 11/2016 | Ito et al. |
| D790,014 | S | 6/2017 | Ito et al. |
| 2002/0082111 | A1 | 6/2002 | Hedrick et al. |
| 2002/0123392 | A1 | 9/2002 | Yamada |
| 2003/0083143 | A1 | 5/2003 | Kumamoto |
| 2003/0125124 | A1 | 7/2003 | Matsumoto et al. |
| 2004/0043825 | A1 | 3/2004 | Horwood et al. |
| 2004/0142760 | A1 | 7/2004 | Haas et al. |
| 2005/0085314 | A1 | 4/2005 | Hsu |
| 2005/0107182 | A1 | 5/2005 | Meyer et al. |
| 2005/0272521 | A1 | 12/2005 | Tsai |
| 2006/0046867 | A1 | 3/2006 | Murphy |
| 2006/0194643 | A1 | 8/2006 | Chen |
| 2006/0211511 | A1 | 9/2006 | Cheng |
| 2007/0026960 | A1 | 2/2007 | Butler, Jr. et al. |
| 2007/0049398 | A1 | 3/2007 | Oyama |
| 2007/0270237 | A1 | 11/2007 | Tavares et al. |
| 2009/0118031 | A1 | 5/2009 | Qualizza |
| 2009/0143161 | A1 | 6/2009 | Qualizza |
| 2010/0317457 | A1 | 12/2010 | Hulock et al. |
| 2012/0100927 | A1 | 4/2012 | Lenzini |
| 2012/0322572 | A1 | 12/2012 | Noble et al. |
| 2013/0017902 | A1 | 1/2013 | Cheng |
| 2013/0095949 | A1 | 4/2013 | Hasegawa et al. |
| 2015/0159783 | A1 | 6/2015 | Ma et al. |
| 2015/0306478 | A1 | 10/2015 | Hicks |
| 2015/0375073 | A1 | 12/2015 | Kodama et al. |
| 2016/0074719 | A1 | 3/2016 | Rice et al. |
| 2017/0065860 | A1 | 3/2017 | Kultala et al. |
| 2017/0340936 | A1 | 11/2017 | Hanamitsu et al. |
| 2019/0232130 | A1 | 8/2019 | Adams et al. |

OTHER PUBLICATIONS

UST Frequency Filtered Putter Shaft; http://www.golfwrx.com/forums/topic/12419-ust-frequency-filtered-putter-shaft/ ; Dec. 4, 2005.

Aldila ONE graphite shaft review; http://www.equip2golf.com/reviews/shafts/aldila_one.html ; at least as early as Oct. 27, 2006.

International Search Report and Written Opinion of the International Searching Authority for International Application No. PCT/US2019/012042, dated Mar. 14, 2019, nineteen pages.

International Search Report and Written Opinion of the International Searching Authority for International Application No. PCT/US20/61904, dated Mar. 11, 2021.

* cited by examiner

| Region | Start (in.) | End (in.) | Avg EI (N•m$^2$) | Avg GJ (N•m$^2$) |
|---|---|---|---|---|
| 1ST PLATEAU | 0 (0%) | 6.3 (18%) | 34 | 26 |
| 2ND PLATEAU | 6.3 (18%) | 9.1 (26%) | 160 | 136 |
| 3RD PLATEAU | 9.1 (26%) | 13.4 (38%) | 76 | 77 |
| 4TH PLATEAU | 13.4 (38%) | 20.0 (57%) | 108 | 100 |
| 5TH PLATEAU | 20.0 (57%) | 35.0 (100%) | 76 | 77 |

| Figure | Section | Start (in.) | End (in.) | Avg EI (N•m-2) | Avg GJ (N•m-2) |
|---|---|---|---|---|---|
| A | Tip 1/2 | 0 (0%) | 17.5 (50%) | 82 | 74 |
| A | Butt 1/2 | 17.5 (50%) | 35.0 (100%) | 81 | 80 |
| | | | | | |
| B | Coupler to Insert End Reinforced Region | 6.3 (18%) | 20.0 (57%) | 109 | 100 |
| B | Combined Non Reinforced Regions | 0 (0%), 20.0 (57%) | 6.3 (18%), 35.0 (100%) | 64 | 62 |

| Figure | Section | Start (in.) | End (in.) | Avg EI (N•m²) | Avg GJ (N•m²) |
|---|---|---|---|---|---|
| C | Tip 1/3 | 0 (0%) | 11.7 (33%) | 74 | 64 |
| C | Butt 2/3 | 11.7 (33%) | 35.0 (100%) | 85 | 83 |
| | | | | | |
| D | Tip 2/3 | 0 (0%) | 23.3 (67%) | 84 | 76.9 |
| D | Butt 1/3 | 23.3 (67%) | 35.0 (100%) | 76 | 76.9 |

| Section | Start (in.) | End (in.) | Avg EI (N•m²) | Avg GJ (N•m²) |
|---|---|---|---|---|
| Tip 1/2 | 0 (0%) | 17.5 (50%) | 42 | 32 |
| Butt 1/2 | 17.5 (50%) | 35.0 (100%) | 112 | 84 |
| Tip 1/3 | 0 (26%) | 11.7 (33%) | 35 | 26 |
| Butt 2/3 | 13.4 (33%) | 35.0 (100%) | 98 | 74 |
| Tip 2/3 | 0 (0%) | 23.3 (67%) | 52 | 39 |
| Butt 1/3 | 23.3 (67%) | 35.0 (100%) | 127 | 95 |

GOLF SHAFT

CROSS-REFERENCE TO RELATED APPLICATIONS

This application is a continuation of U.S. nonprovisional application Ser. No. 16/237,894, filed on Jan. 2, 2019, which is a continuation of U.S. nonprovisional application Ser. No. 15/884,683, filed on Jan. 31, 2018, now U.S. Pat. No. 10,213,666, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to a golf club shaft.

BACKGROUND OF THE INVENTION

During the course of a golf swing, the club shaft is under a load and is subject to often significant deflection and torsional rotation. Few have recognized that this deflection and rotation, albeit on a much smaller scale, also happens during the course of a putting stroke, particularly as the head weight of putter heads increases. As used herein, "stability" of a shaft refers to how the toe and heel of the club face track one another through the stroke. The relative volatility of the velocity and acceleration of the toe and heel of the club face pre-impact, at impact, and post-impact can be significantly improved. Controlling the face angle and face twist results in a tighter departure angle range for the ball leaving the face and significantly improves the likelihood of the ball leaving the face at an angle closer to the target line, which in the case of putters improves the likelihood of making a putt.

While driver, fairway metal, and hybrid shafts have evolved over the past 30 plus years, from steel tubes to a variety of often complex composite shafts, putter shafts have not evolved at pace. No serious golfer trusts their driver to perform optimally with an inexpensive steel shaft. Why would any serious golfer, if they had a better option, trust their putter to work best with a cheap steel shaft? After all, a putter is used almost twice as much as any other club in the bag. Most conventional putter shafts are simply steel pipes (wrapped and welded construction) containing little to no engineered aspects tailored to the unique situation of putting. They are narrow in the tip and taper to a larger diameter at the butt-end for gripping purposes, and consequently exhibit inherent weakness in the lower portion of the shaft. Ultimately, the impetus for steel shafts continued preeminence is cost: steel shafts are used by putter manufacturers primarily because they are so cheap.

The present invention provides significant advances tailored to putter shafts, but are also applicable to all golf shafts.

SUMMARY OF THE INVENTION

A golf shaft having a butt portion joined to a tip portion by a coupler and possessing unique relationships, including rigidity relationships, which provide beneficial performance characteristics including improved stability.

BRIEF DESCRIPTION OF THE DRAWINGS

Without limiting the scope of the present invention as claimed below and referring now to the drawings and figures:

Figure 1:
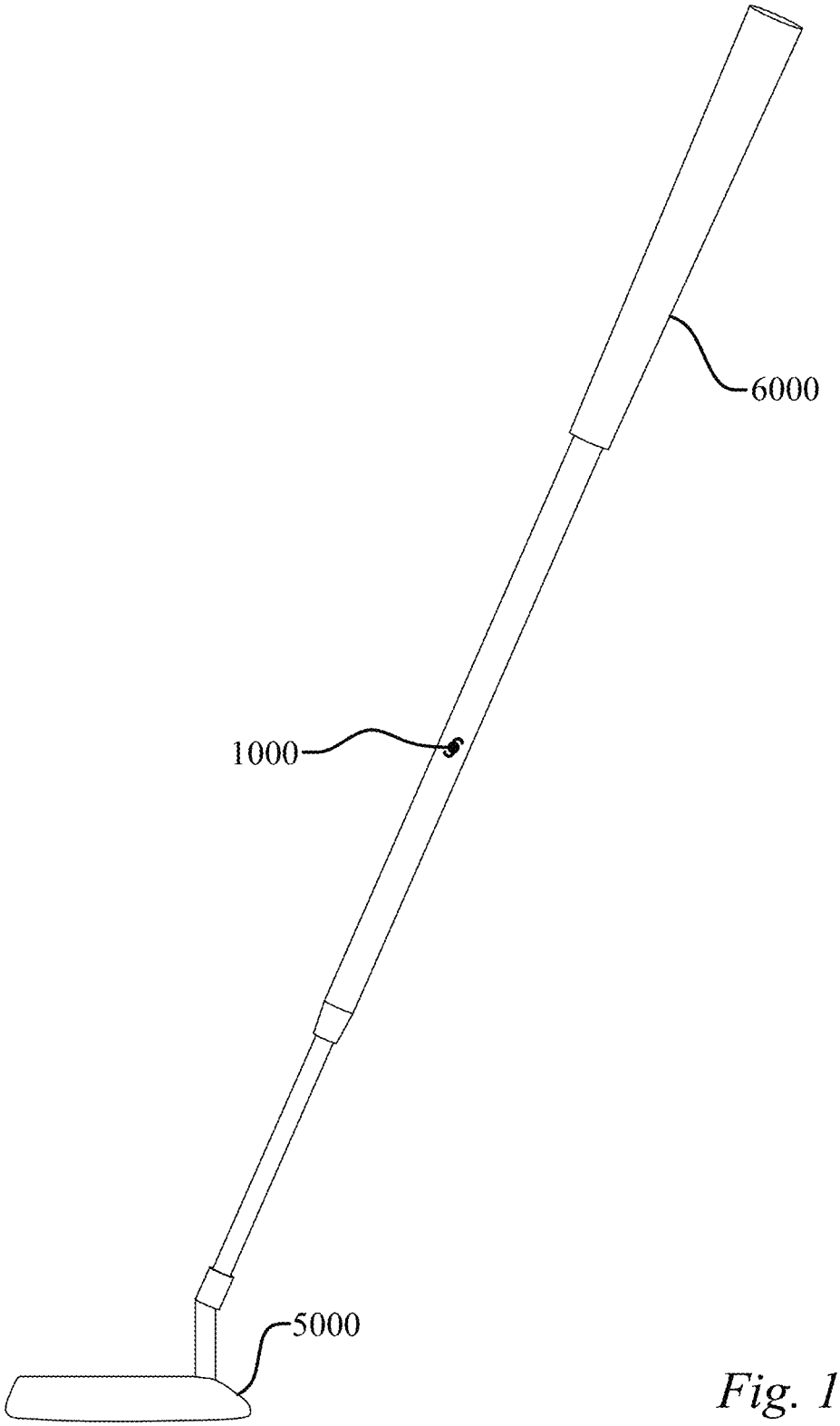
FIG. 1 shows a front elevation view of a golf club, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

As seen in FIGS. 1-8, an embodiment of the shaft (100) of the present invention includes a shaft distal end (110), a shaft proximal end (120), a shaft outer diameter, and a shaft mass, wherein each point along the shaft length (130) has a shaft flexural rigidity, often abbreviated EI, and a shaft torsional rigidity, often abbreviated GJ. The shaft (100) may include a butt portion (1000) joined to a tip portion (2000) by a coupler (3000), wherein the coupler (3000) may permanently, or releasably, attach the butt portion (1000) to the tip portion (2000). It is important to appreciate that the shaft flexural rigidity and the shaft torsional rigidity may be taken at points along the shaft length (100) that take into account areas of the shaft (100) composed of multiple elements within a cross-section taken perpendicular to a shaft axis, while later disclosed flexural rigidity and torsional rigidity of a specific element are rigidities associated solely with that particular element rather than the combination of elements that may compose the shaft (100).

Figure 6A:
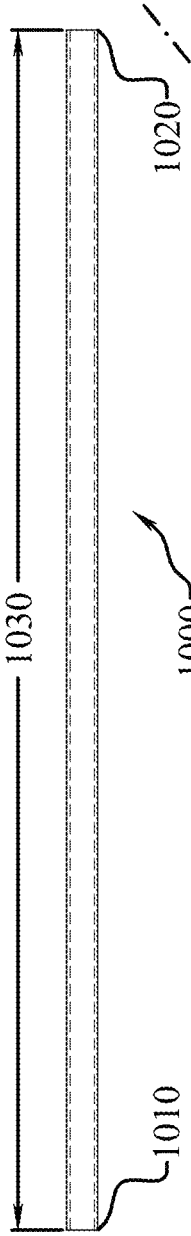
FIG. 6(A) shows a side elevation view of an embodiment of a butt portion, not to scale.
Figure 6B:
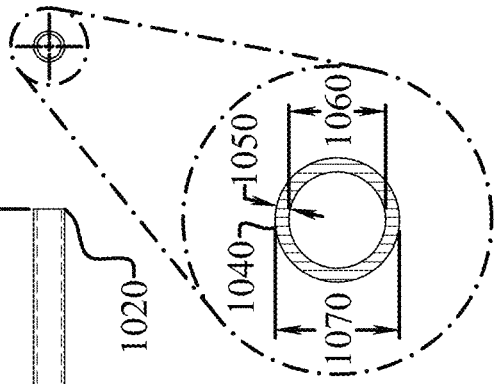
FIG. 6(B) shows an end elevation view of an embodiment of a butt portion, not to scale.

The butt portion (1000), specifically seen in FIGS. 6(A) and 6(B), has a butt portion distal end (1010), a butt portion proximal end (1020), a butt portion length (1030), a butt portion sidewall (1040) having a butt portion sidewall thickness (1050), a butt portion inner diameter (1060), and a butt portion outer diameter (1070). Similarly, the tip portion (2000), specifically seen in FIGS. 5(A) and 5(B), has a tip portion distal end (2010), a tip portion proximal end (2020), a tip portion length (2030), a tip portion sidewall (2040) having a tip portion sidewall thickness (2050), a tip portion inner diameter (2060), and a tip portion outer diameter (2070). In some embodiments the tip portion length (2030) is no more than 65% of the butt portion length (1030), and in some additional embodiments at least a portion of the tip portion (200) has a tip portion outer diameter (2070) that is at least 25% less than the butt portion outer diameter (1070) of a portion of the butt portion (1000). Further, the coupler (3000), specifically seen in FIGS. 8(A) and 8(B), has a coupler distal end (3010), a coupler proximal end (3020), a coupler length (3030), a coupler sidewall (3040) having a coupler sidewall thickness (3050), a coupler inner diameter (3060), and a coupler outer diameter (3070). In one particular embodiment at least a portion of the butt portion (1000) has a butt portion sidewall thickness (1050) that is greater than the tip portion sidewall thickness (2050) of a portion of the tip portion (2000), while in a further embodiment the butt portion sidewall thickness (1050) is at least 15% greater than the tip portion sidewall thickness (2050), and in yet another embodiment the butt portion sidewall thickness (1050) is at least 25% greater than the tip portion sidewall thickness (2050). In another embodiment an average coupler sidewall thickness (3050) throughout the coupler length (3030) is greater than an average butt portion sidewall thickness (1050), and in yet a further embodiment the average coupler sidewall thickness (3050) is greater than an average tip portion sidewall thickness (2050). In still a further embodiment the average coupler sidewall thickness (3050) is at least 15% greater than the average butt portion sidewall thickness (1050), and in yet a further embodiment the average coupler sidewall thickness (3050) is at least 15% greater than the average tip portion sidewall thickness (2050).

In some embodiments the butt portion (1000) is formed of a non-metallic butt portion material having a butt material density, a butt portion mass that is 35-75% of the shaft mass, a butt portion elastic modulus, a butt portion shear modulus, and each point along the butt portion length (1030) has a butt portion area moment of inertia, a butt portion polar moment of inertia, a butt portion flexural rigidity, and a butt portion torsional rigidity. The density of the butt portion (1000) may be constant or it may vary throughout the butt portion length (1030). Likewise, in some additional embodiments the tip portion (2000) is formed of a metallic tip portion material having a tip material density that is at least 15% greater than the butt material density, a tip portion elastic modulus, and a tip portion shear modulus, and each point along the tip portion length (2030) has a tip portion area moment of inertia, a tip portion polar moment of inertia, a tip portion flexural rigidity that in some embodiments is less than the butt portion flexural rigidity, and a tip portion torsional rigidity that in some embodiments is less than the butt portion torsional rigidity.

Figure 13A:
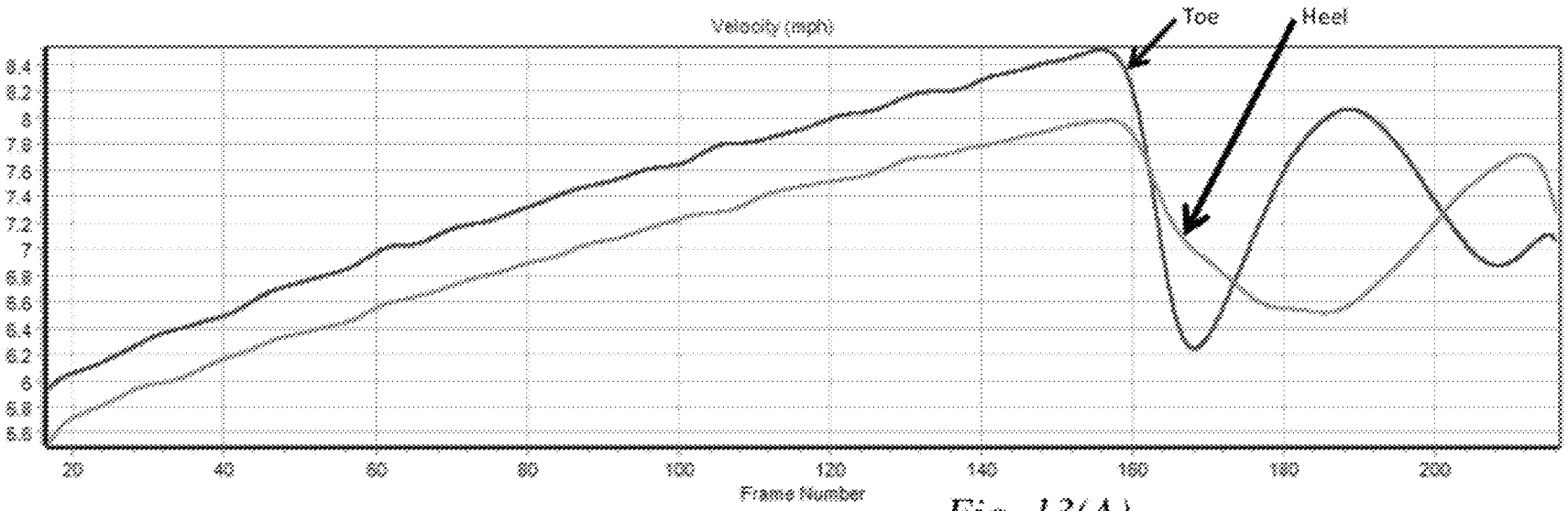
FIG. 13(A) shows a graph of the heel and toe velocity of a putter head through a putting stroke, not to scale.

The material, density, weight, rigidity, kickpoint distance, shaft CG distance, and shaft length relationships disclosed herein each, and in combination, are critical to the feel, flex, and stability of the shaft (100) to produce unexpected benefits when striking a golf ball with a golf club head (5000) attached to the shaft (100). These relationships provide less twisting of the face, as well as improved consistency of the face velocity and acceleration of the heel and toe portions, both prior to, at, and after impact, as will be explained in more detail later with respect to FIGS. 14(A) and 14(B) compared to FIGS. 13(A) and 13(B). One skilled in the art will understand that that during the course of a swing, the golf shaft is under a load and is subject to significant deflection and torsional rotation, however, few have recognized that deflection and rotation, albeit on a much smaller scale, also happen during the course of a putting stroke, particularly as the head weight of putter heads increases. As used herein, "stability" of the shaft refers to how the toe and heel of the club face track one another through the stroke. The relative volatility of the velocity and acceleration of the toe and heel of the club face pre-impact, at impact, and post-impact is significantly improved by these relationships. For instance, controlling the face twist results in a tighter departure angle of the ball leaving the face and significantly improves the likelihood of the ball leaving the face at an angle closer to the target line, which in the case of putters improves the likelihood of making a putt. Experiments have shown that the putter departure angle range is reduced 20%-33% depending on the type of putter and type of stroke employed, without a reduction in feel at and after impact. Additionally, these relationships, particularly during low speed impacts associated with putting, produce lower launch of the ball off the face, which for putters has been linked to achieving true roll sooner, leading to a ball that slows down more predictably, thus affording better distance control for the golfer.

Figure 2:
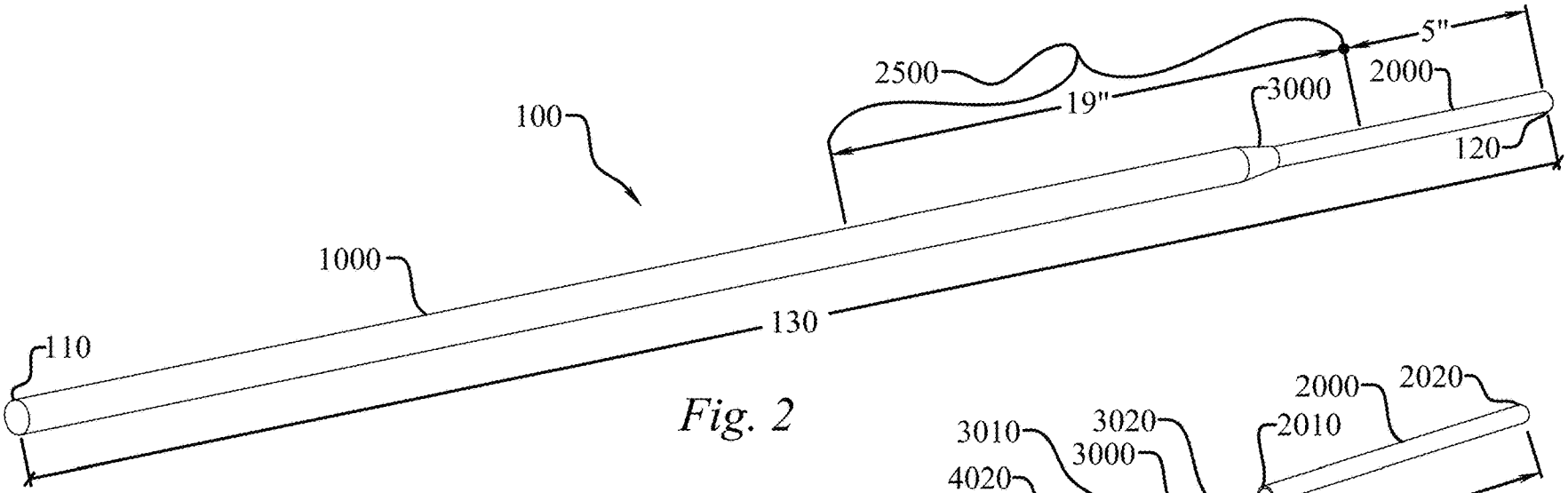
FIG. 2 shows a perspective view of an embodiment of the a golf shaft, not to scale.
Figure 3:
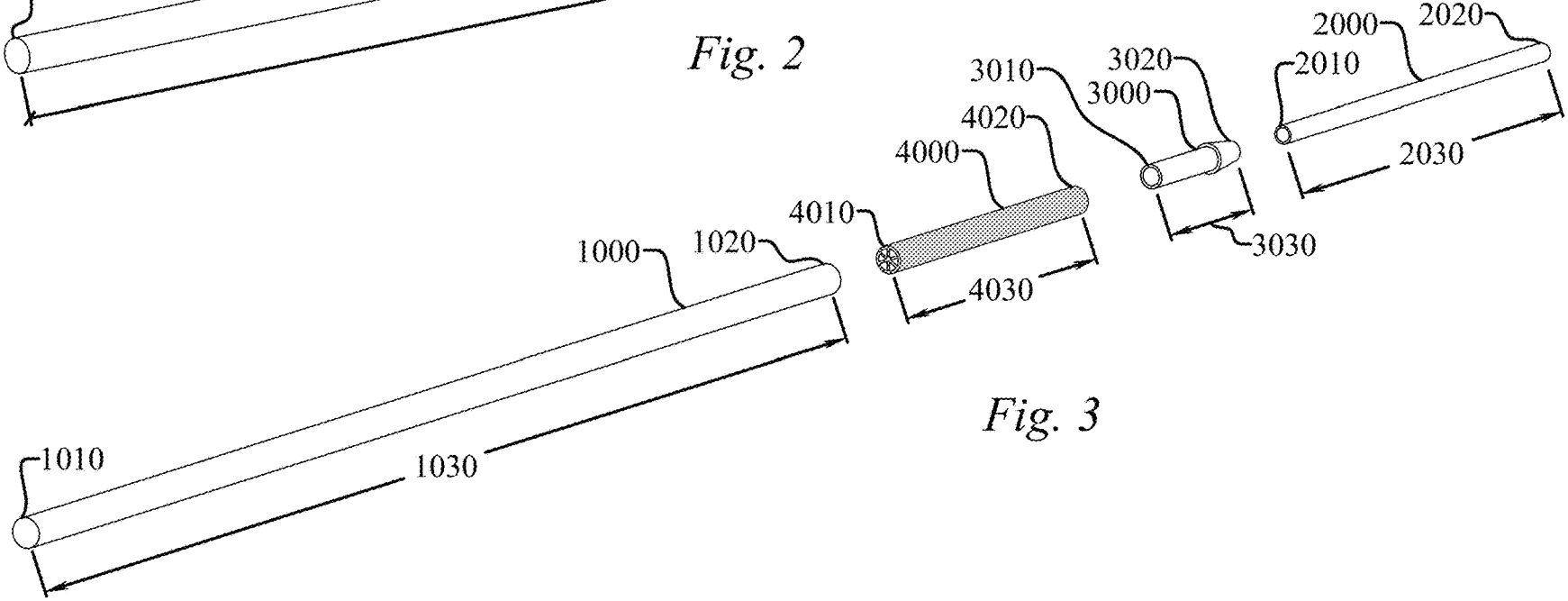
FIG. 3 shows an exploded perspective view of an embodiment of the a golf shaft, not to scale.
Figure 10:
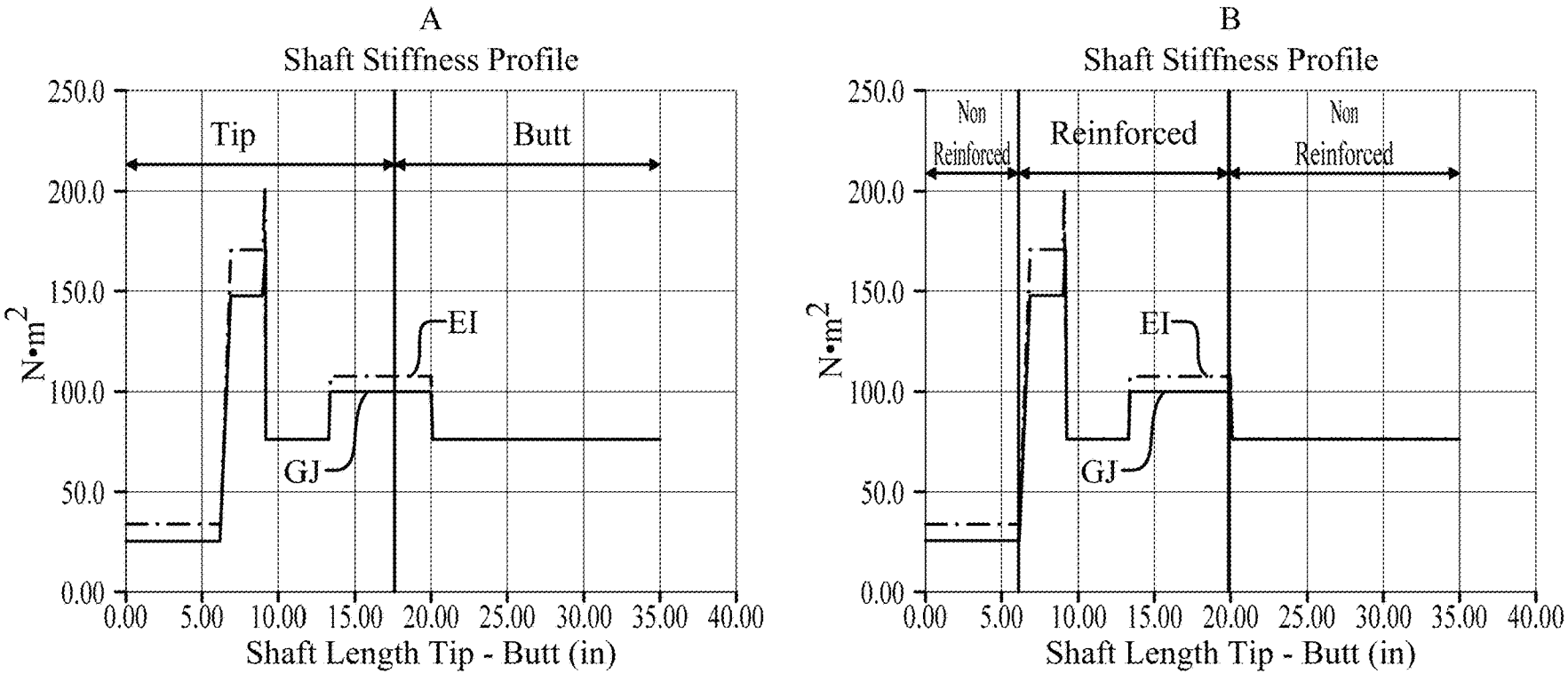
FIG. 10 shows graphs of the shaft stiffness profile of an embodiment of the golf shaft, not to scale.

Similarly, the benefits are further enhanced via unique relationships provided when the shaft (100) includes a reinforced region (2500), seen in FIG. 2, is located between a first point located 5" from the shaft proximal end (120) and a second point located 24" from the shaft proximal end (120). As best seen in FIG. 10, in a first portion of the reinforced region (2500) the shaft flexural rigidity is at least 50% greater than a minimum tip portion flexural rigidity and less than 100 $N*m^2$, and the shaft torsional rigidity is at least 50% greater than a minimum tip portion torsional rigidity and less than 100 $N*m^2$, while in a second portion of the reinforced region (2500) the shaft flexural rigidity is at least 50% greater than a minimum butt portion flexural rigidity and is greater than 120 N*m$^2$, and the shaft torsional rigidity is at least 50% greater than a minimum butt portion torsional rigidity and is greater than 120 N*m$^2$. In another embodiment the "a minimum" language of the prior sentence is replaced with "an average," and in an even further embodiment the "a minimum" language of the prior sentence is replaced with "a maximum." One skilled in the art will appreciate that these rigidities of the tip portion and the butt portion may be constant, and thus the minimum, maximum, and average will be equal, or the rigidities may vary throughout the cited component and therefore possess a distinct minimum, maximum, and average; and these minimum, maximum, and average substitutions embodiments apply equally to all embodiments disclosed herein.

Thus, the reinforced region (2500) has a first portion with both flexural and torsional rigidity significantly higher than that of the tip portion (2000), but also a second portion that is even higher that than of the first portion and significantly higher than that of the butt portion (1000), in addition to the rigidity of the butt portion (1000) being higher than that of the tip portion (2000). In another related embodiment the first portion of the reinforced region (2500) has the shaft flexural rigidity at least 75% greater than the minimum tip portion flexural rigidity while also being less than 90 N*m$^2$, and the shaft torsional rigidity is at least 75% greater than the minimum tip portion torsional rigidity while also being less than 90 N*m$^2$. In still a further related embodiment the second portion of the reinforced region (2500) has the shaft flexural rigidity at least 75% greater than the minimum butt portion flexural rigidity and also greater than 135 N*m$^2$, and the shaft torsional rigidity is at least 75% greater than the minimum butt portion torsional rigidity and also greater than 135 N*m$^2$.

Figure 11:
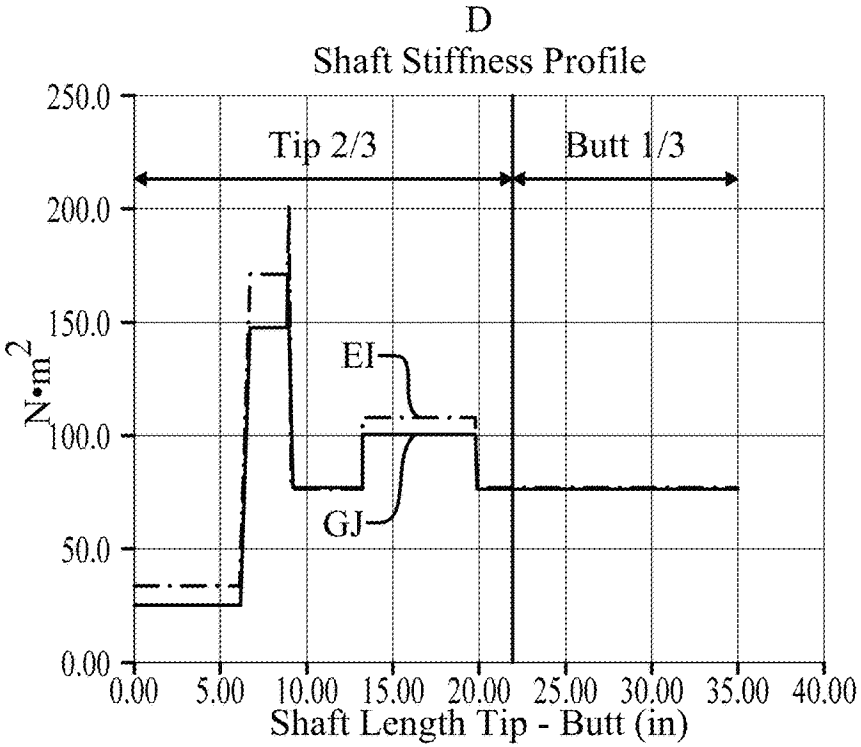
FIG. 11 shows graphs of the shaft stiffness profile of an embodiment of the golf shaft, not to scale.
Figure 11:
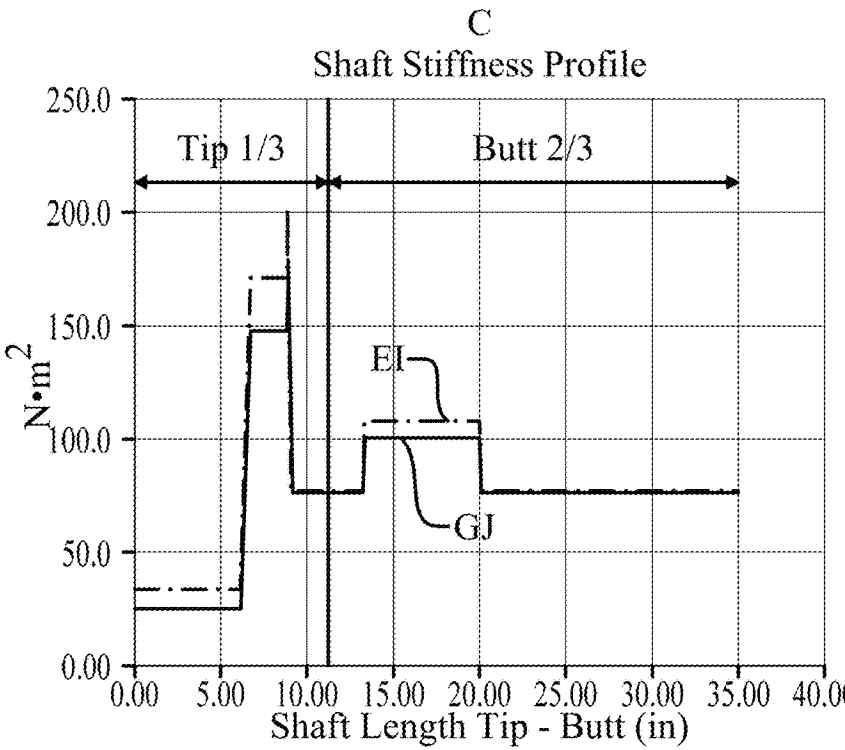

In addition, the benefits are enhanced further via unique relationships provided when a first portion of the shaft (100) extending ⅔ of the shaft length (130) from the shaft proximal end (120) has a first average flexural rigidity, a second portion of the shaft (100) extending ⅓ of the shaft length (130) from the shaft distal end (110) has a second average flexural rigidity, and the first average flexural rigidity is at least 50% of the second average flexural rigidity, as illustrated in FIG. 11. For comparison, a typical steel shaft is more than twice as stiff in the upper ⅓ portion compared to the lower ⅔ portion. In another embodiment the first average flexural rigidity is at least 75% of the second average flexural rigidity. In a further related embodiment the first average flexural rigidity is at least 100% of the second average flexural rigidity, while in still another related embodiment the first average flexural rigidity is 75-200% of the second average flexural rigidity, and in yet another related embodiment the first average flexural rigidity is 100-150% of the second average flexural rigidity.

As one skilled in the art will appreciate, the flexural rigidities discussed herein, which are often also referred to as bending stiffness, are based upon the material stiffness, or elastic modulus (E), and the cross-section geometry properties associated with the area moment of inertia (I), which is why the flexural rigidity is often referred to as EI. For a simple tube the area moment of inertia (I) is:

$$I = \frac{\pi}{4}(r_o^4 - r_i^4)$$

Where $r_o$ is the outside radius of the tube and $r_i$ is the inner radius of the tube.

Additionally, the torsional rigidities discussed herein, which are often referred to as torsional stiffness, are based upon the material torsional stiffness, or shear modulus (G), and the cross-section geometry properties associated with the polar moment of inertia (J), which is why the torsional rigidity is often referred to as GJ. For a simple tube the polar moment of inertia (J) is:

$$J = \frac{\pi}{2}(r_o^4 - r_i^4)$$

Where $r_o$ is the outside radius of the tube and $r_i$ is the inner radius of the tube.

Figure 4:
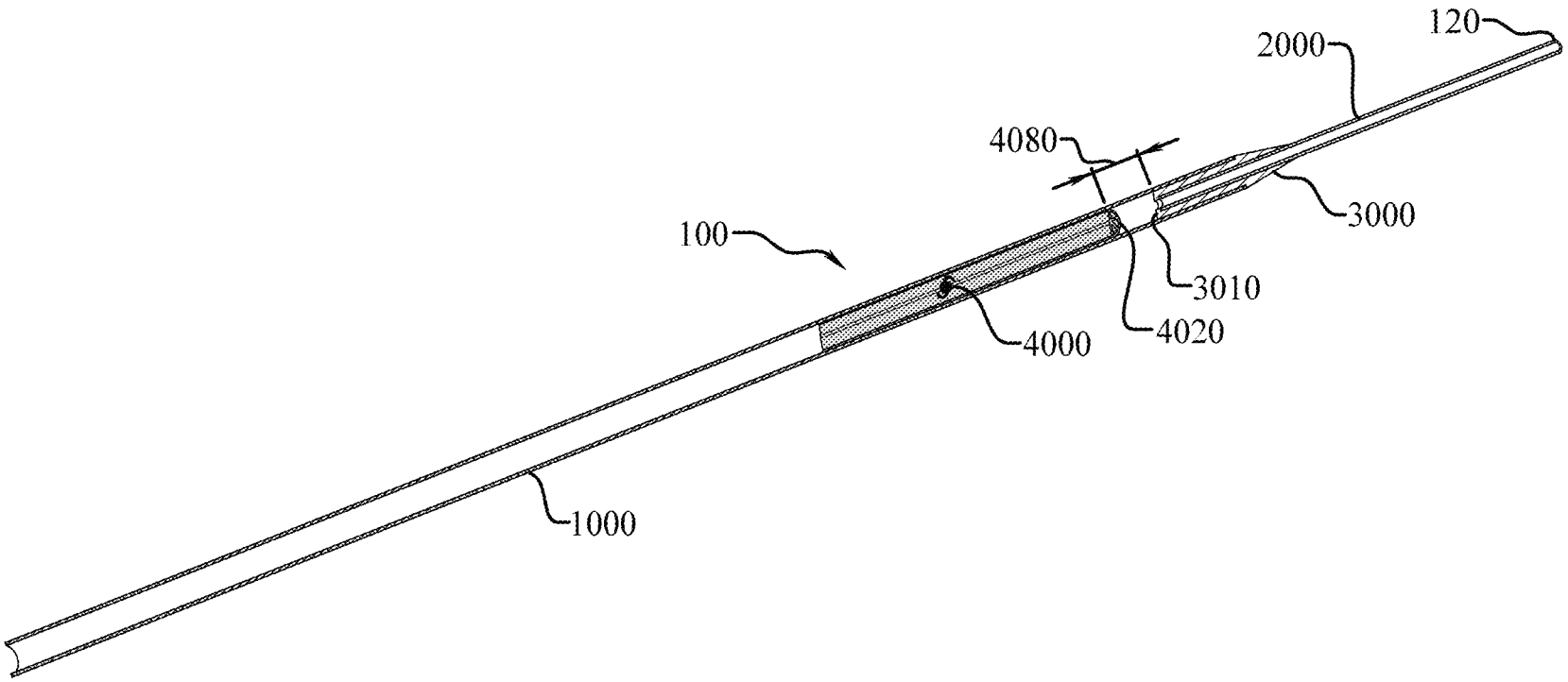
FIG. 4 shows a perspective cross-sectional view of an embodiment of the a golf shaft, not to scale.
Figure 5A:
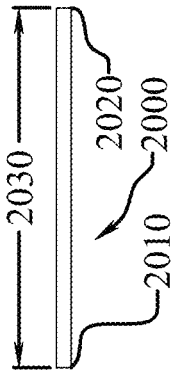
FIG. 5(A) shows a side elevation view of an embodiment of a tip portion, not to scale.
Figure 5B:
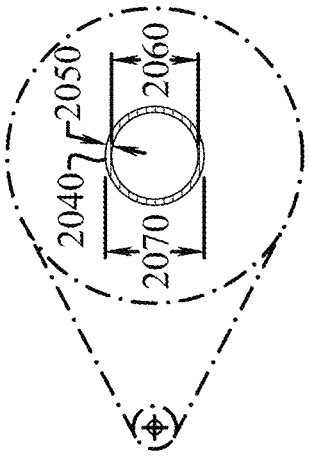
FIG. 5(B) shows an end elevation view of an embodiment of a tip portion, not to scale.

One skilled in the art will appreciate these simple equations work well for the individual elements, however when determining the rigidities for the overall shaft flexural rigidity and the shaft torsional rigidity there will be points that need to factor in the various layers of elements. For example, as seen in FIG. 4, starting at the tip portion (2000) the calculations will be easy until the tip portion (2000) enters into the coupler (3000), at which point the shaft rigidity calculations must account for the overlap of the coupler (3000) and the tip portion (2000); then a little further into the coupler (3000) the shaft rigidity calculations must account for the overlap of the coupler (3000), the tip portion (2000), and the butt portion (1000); then past the coupler (3000) and within a separation distance (4080) the shaft rigidity calculations are simplified again until reaching the area of a butt portion insert (4000) whereby the shaft rigidity calculations must account for the butt portion (1000) and the butt portion inert (4000). This is just one illustrative example, but highlights the fact that the overall shaft flexural rigidity and the shaft torsional rigidity at various points through the length of the shaft length (130) has to account for multiple elements, whereas references to flexural rigidity and the torsional rigidity of individual components are solely for the referenced individual components, which is an important distinction.

In another embodiment the previously discussed benefits are further achieved in an embodiment having a minimum tip portion flexural rigidity that is at least 25% less than a maximum butt portion flexural rigidity, and the minimum tip portion torsional rigidity is at least 25% less than a maximum butt portion torsional rigidity. Still further, in another embodiment the minimum tip portion flexural rigidity is 25-75% less than the maximum butt portion flexural rigidity, and the minimum tip portion torsional rigidity is 25-75% less than the maximum butt portion torsional rigidity. In another embodiment the previously discussed benefits are further achieved in an embodiment having a minimum tip portion flexural rigidity that is at least 25% less than the minimum butt portion flexural rigidity, and the minimum tip portion torsional rigidity is at least 25% less than the minimum butt portion torsional rigidity. Still further, in another embodiment the minimum tip portion flexural rigidity is 25-75% less than the minimum butt portion flexural rigidity, and the minimum tip portion torsional rigidity is 25-75% less than the minimum butt portion torsional rigidity.

In one embodiment such relationships are achieved by having a shaft outer diameter that is constant throughout at least 50% of the shaft length (130), thereby ensuring such beneficial relationships are maintained. In yet another embodiment the shaft outer diameter is constant throughout at least 75% of the shaft length (130), while in a further embodiment the butt portion outer diameter (1070) is constant throughout the entire butt portion length (1030), and in still another embodiment the tip portion outer diameter (2070) is constant throughout at least 50% of the tip portion length (2030), and at least 75% in still another embodiment.

The beneficial relationships may further be achieved and maintained by controlling the lengths of the individual components. In one such embodiment the tip portion length (2030) is no more than 55% of the butt portion length (1030), while in another embodiment the tip portion length (2030) is at least 15% of the butt portion length (1030), and in yet another embodiment the tip portion length (2030) is at least 4", and 4-16" in another embodiment, and 6-12" in still a further embodiment. In another such embodiment the butt portion length (1030) is at least twice the tip portion length (2030), while in another embodiment the butt portion length (1030) is at least three times the tip portion length (2030), and in still a further embodiment the butt portion length (1030) is at least 2-5 times the tip portion length (2030), and in still a further embodiment the butt portion length (1030) is at least 2.5-4 times the tip portion length (2030). In yet another embodiment the butt portion length (1030) is at least 16", and at least 20" in another embodiment, and at least 24" in still a further embodiment. Further embodiments cap the butt portion length (1030) to no more than 48", and no more than 42" in another embodiment, and no more than 36" in a further embodiment, and no more than 30" in still another embodiment, and no more than 28" in still a further embodiment.

In an even further embodiment the shaft flexural rigidity is constant throughout at least 10% of the shaft length (130), and the shaft torsional rigidity is constant throughout at least 10% of the shaft length (130). While in still a further embodiment the shaft flexural rigidity is constant throughout at least 25% of the shaft length (130), and the shaft torsional rigidity is constant throughout at least 25% of the shaft length (130). While in yet still another embodiment the shaft flexural rigidity is constant throughout at least 40% of the shaft length (130), and the shaft torsional rigidity is constant throughout at least 40% of the shaft length (130). In a further embodiment the shaft flexural rigidity is constant throughout at least 50% of the shaft length (130), and the shaft torsional rigidity is constant throughout at least 50% of the shaft length (130). Similarly, adding a cap to the range, in a further embodiment the shaft flexural rigidity is constant throughout no more than 90% of the shaft length (130), and the shaft torsional rigidity is constant throughout no more than 90% of the shaft length (130). In yet another embodiment the shaft flexural rigidity is constant throughout no more than 75% of the shaft length (130), and the shaft torsional rigidity is constant throughout no more than 75% of the shaft length (130). In still a further embodiment the shaft flexural rigidity is constant throughout no more than 60% of the shaft length (130), and the shaft torsional rigidity is constant throughout no more than 60% of the shaft length (130).

Such relationships may also be achieved by maintaining a tip portion outer diameter (2070) no more than 60% less than the maximum butt portion outer diameter (1070), and in another embodiment by having a coupler (3000) with a coupler mass that is no more than 15% of the shaft mass. Further mass relationships achieve the benefits by also controlling the mass of specific components. For example, in one embodiment the coupler mass is at least 5% of the shaft mass, while in another embodiment the butt portion mass is 40-70% of the shaft mass, and in yet a further embodiment the butt portion mass is 45-65% of the shaft mass. Likewise, in another embodiment the tip portion (2000) has a tip portion mass that is no more than 85% of the butt portion mass, while in another embodiment the tip portion mass is no more than 75% of the butt portion mass, and in yet a further embodiment the tip portion mass is 35-75% of the butt portion mass. The butt portion mass is preferably no more than 85 grams, and no more than 75 grams in another embodiment, and no more than 65 grams in still a further embodiment. Yet a further series of embodiments cap the lower range of the butt portion mass with one embodiment having a butt portion mass of at least 40 grams, and a butt portion mass of at least 50 grams in another embodiment, and a butt portion mass of at least 60 grams in still a further embodiment. The coupler mass is preferably no more than 25 grams, and no more than 20 grams in another embodiment, and no more than 15 grams in still a further embodiment. Yet a further series of embodiments cap the lower range of the coupler mass with one embodiment having a coupler mass of at least 5 grams, and at least 7.5 grams in another embodiment, and at least 10 grams in still a further embodiment.

The coupler (3000) is formed of a coupler material having a coupler material density, a coupler mass, a coupler elastic modulus, a coupler shear modulus, and each point along the coupler length (3030) has (i) a coupler flexural rigidity, and (ii) a coupler torsional rigidity. In an embodiment at least a portion of coupler (3000) has a coupler flexural rigidity that is greater than the tip portion flexural rigidity of a portion of the tip portion (2000), and at least a portion of the coupler (3000) has a coupler torsional rigidity that is greater than the tip portion torsional rigidity of a portion of the tip portion (2000). Another embodiment has at least a portion of the coupler (3000) with a coupler flexural rigidity that is greater than the butt portion flexural rigidity of a portion of the butt portion (1000), and at least a portion of the coupler (3000) with a coupler torsional rigidity is greater than the butt portion torsional rigidity of a portion of the butt portion (1000). A further embodiment has at least a portion of coupler (3000) with a coupler flexural rigidity that is 75% greater than the tip portion flexural rigidity of a portion of the tip portion (2000), and at least a portion of the coupler (3000) with a coupler torsional rigidity that is 75% greater than the tip portion torsional rigidity of a portion of the tip portion (2000). A still further embodiment has a portion of coupler (3000) with a coupler flexural rigidity that is 100-500% greater than the tip portion flexural rigidity of a portion of the tip portion (2000), and at least a portion of the coupler (3000) with a coupler torsional rigidity that is 100-500% greater than the tip portion torsional rigidity of a portion of the tip portion (2000). Yet a still further embodiment has a portion of coupler (3000) with a coupler flexural rigidity that is 200-500% greater than the tip portion flexural rigidity of a portion of the tip portion (2000), and at least a portion of the coupler (3000) with a coupler torsional rigidity that is 200-500% greater than the tip portion torsional rigidity of a portion of the tip portion (2000). Even further, another embodiment has a portion of coupler (3000) with a coupler flexural rigidity that is 300-500% greater than the tip portion flexural rigidity of a portion of the tip portion (2000), and at least a portion of the coupler (3000) with a coupler torsional rigidity that is 300-500% greater than the tip portion torsional rigidity of a portion of the tip portion (2000).

The disclosed rigidity relationships may be obtained in a number of manners, one of which consists of varying the butt portion inner diameter (1060) throughout the butt portion length (1030) to achieve the disclosed reinforced region (2500) rigidity relationships, and/or the rigidity relationships associated with the first portion of the shaft (100) extending ⅔ of the shaft length (130) from the shaft proximal end (120) and the second portion of the shaft (100) extending ⅓ of the shaft length (130) from the shaft distal end (110). In another embodiment any of these relationships may be obtained by embedding a reinforcement material within the butt portion sidewall (1040) without the need for a varying butt portion inner diameter (1060). In such embodiments the reinforcement material may consist of a tube of higher rigidity material extending around all 360 degrees of a cross-section of the butt portion (1000), or may consists of inserts that are localized and do not extend around all 360 degrees of a cross-section of the butt portion (1000).

In another embodiment any of these relationships may be obtained by further including a butt portion insert (4000), seen in FIGS. 3, 4, 7(A), and 7(B), attached in the butt portion (1000) and having a butt portion insert distal end (4010), a butt portion insert proximal end (4020), a butt portion insert length (4030) that is at least 25% of the tip portion length (2030), a butt portion insert sidewall (4040) having a butt portion insert sidewall thickness (4050), a butt portion insert inner diameter (4060), and a butt portion insert outer diameter (4070) that is less than the butt portion inner diameter (1060), wherein majority of the butt portion insert length (4030) is within the reinforced region (2500). In another embodiment the butt portion insert length (4030) is at least 50% of the tip portion length (2030) and no more than 50% of the butt portion length (1030), while in yet a further embodiment the butt portion insert length (4030) is at least 10% of the butt portion length (1030) and no more than 150% of the tip portion length (2030), and in yet another embodiment the butt portion insert inner diameter (4060) is greater than the tip portion inner diameter (2060). In still a further embodiment at least 75% of the butt portion insert length (4030) is within the reinforced region (2500), while in another embodiment the entire butt portion insert (4000) is within the reinforced region (2500). As seen in FIG. 4, in another embodiment the butt portion insert proximal end (4020) is separated from the coupler distal end (3010) by a separation distance (4080) that is at least 50% of the butt portion outer diameter (1070), thereby achieving the disclosed drop in rigidity between the butt portion insert (4000) and the coupler (3000). In one such embodiment the separation distance (4080) is no more than five times the butt portion outer diameter (1070), while in another embodiment the separation distance (4080) is no more than 50% of the butt portion insert length (4030).

In one embodiment the butt portion insert length (4030) is at least 2", while in another embodiment it is at least 4", while in yet a further embodiment it is at least 6". However, additional embodiments restrict the butt portion insert length (4030) so as not to diminish the benefits associated with the butt portion insert (4000). Specifically, in one embodiment the butt portion insert length (4030) is no more than 12", while in another embodiment the butt portion insert length (4030) is no more than 10", and in yet a further embodiment the butt portion insert length (4030) is no more than 8". Additionally, the placement of the butt portion insert (4000) is essential to providing the described benefits. In one particular embodiment a distance from the butt portion insert proximal end (4020) to the shaft proximal end (120) is at least 7", and is at least 9" in another embodiment, and is at least 11" in yet a further embodiment. Additional embodiments reduce the likelihood of diminishing the benefits associated with the butt portion insert (4000) by controlling this distance. For example, in one embodiment the distance from the butt portion insert proximal end (4020) to the shaft proximal end (120) is no more than 18", and is no more than 16" in another embodiment, and no more than 14" in yet a further embodiment.

One skilled in the art will appreciate that the butt portion insert (4000) has a center of gravity, or CG, and the location of the butt portion insert CG significantly influences the benefits associated with the golf shaft (100). In one such embodiment the butt portion insert CG is located a distance from the shaft proximal end (120) that is at least 9", and at least 11" in another embodiment, and at least 13" in yet a further embodiment. In some embodiments reduction in the benefits associated with the butt portion insert (4000) have been observed when this distance from the shaft proximal end (120) becomes too large. Therefore, in another embodiment butt portion insert CG is located a distance from the shaft proximal end (120) that is no more than 19", and no more than 17" in another embodiment, and no more than 15" in still a further embodiment. In another embodiment a separation distance from the shaft CG distance to the distance that the butt portion insert CG is spaced from the shaft proximal end (120), is less than the butt portion insert length (4030), and no more than 75% of the butt portion insert length (4030) in another embodiment, and no more than 50% of the butt portion insert length (4030) in still a further embodiment. Another variation has a second separation distance defined as the distance from a kickpoint distance, defined later, to the location of the butt portion insert CG when installed in the shaft, and the second separation distance is less than the butt portion insert length (4030), and no more than 75% of the butt portion insert length (4030) in another embodiment, and no more than 50% of the butt portion insert length (4030) in still a further embodiment. Thus, in an embodiment the locations of the shaft CG and the kickpoint fall between the butt portion insert distal end (4010) and the a butt portion insert proximal end (4020), when the insert is installed in the shaft.

The butt portion insert (4000) is formed of a butt portion insert material having a butt portion insert material density, a butt portion insert mass, a butt portion insert elastic modulus, a butt portion insert shear modulus, and each point along the butt portion insert length (4030) has (i) a butt portion insert flexural rigidity, and (ii) a butt portion insert torsional rigidity. In an embodiment at least a portion of butt portion insert (4000) has a butt portion insert flexural rigidity that is greater than the tip portion flexural rigidity of a portion of the tip portion (2000), and at least a portion of the butt portion insert (4000) has a butt portion insert torsional rigidity that is greater than the tip portion torsional rigidity of a portion of the tip portion (2000). Another embodiment has at least a portion of the butt portion insert (4000) with a butt portion insert flexural rigidity that is greater than the butt portion flexural rigidity of a portion of the butt portion (1000), and at least a portion of the butt portion insert (4000) with a butt portion insert torsional rigidity is greater than the butt portion torsional rigidity of a portion of the butt portion (1000). A further embodiment has at least a portion of butt portion insert (4000) with a butt portion insert flexural rigidity that is 75% greater than the tip portion flexural rigidity of a portion of the tip portion (2000), and at least a portion of the butt portion insert (4000) with a butt portion insert torsional rigidity that is 75% greater than the tip portion torsional rigidity of a portion of the tip portion (2000). A still further embodiment has a portion of butt portion insert (4000) with a butt portion insert flexural rigidity that is 100-300% greater than the tip portion flexural rigidity of a portion of the tip portion (2000), and at least a portion of the butt portion insert (4000) with a butt portion insert torsional rigidity that is 100-300% greater than the tip portion torsional rigidity of a portion of the tip portion (2000).

Figure 7A:
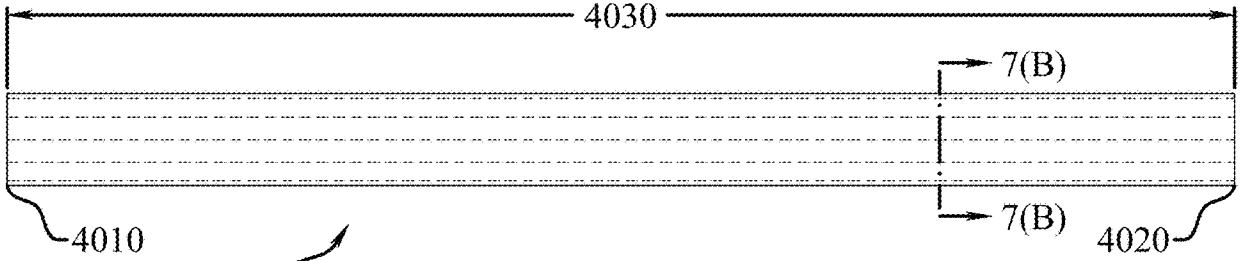
FIG. 7(A) shows a side elevation view of an embodiment of a butt portion insert, not to scale.
Figure 7B:
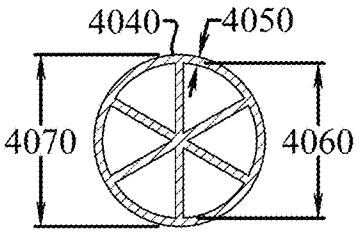
FIG. 7(B) shows an end elevation view of an embodiment of a butt portion insert, not to scale.

As seen in FIG. 7(B), the butt portion insert (4000) may be a hollow tubular structure, which may include at least one structural support spanning across the interior and passing through the center of the butt portion insert (4000). In a further embodiment, a structural support length, that extending into and out of the page in FIG. 7(B) is at least 1/16", and at least 1/8" in another embodiment, and at least 1/4" in still a further embodiment. In the embodiment of FIG. 7(A) the structural support length is at least 50% of the butt portion insert length (4030), while in another embodiment it is at least 75% of the butt portion insert length (4030), and in still a further embodiment it is at least 90% of the butt portion insert length (4030).

A further embodiment includes at least 2 structural supports spanning across the interior and passing through, and intersecting at, the center of the butt portion insert (4000), while another embodiment includes at least 3. The butt portion insert sidewall thickness (4050) is preferably no more than the butt portion sidewall thickness (1050), while in another embodiment the butt portion insert sidewall thickness (4050) is preferably no more than 75% of the butt portion sidewall thickness (1050), and in yet a further embodiment the butt portion insert sidewall thickness (4050) is preferably no more than 50% of the butt portion sidewall thickness (1050). In another series of embodiments the butt portion insert sidewall thickness (4050) is at least 50% of the tip portion sidewall thickness (2050), while in another embodiment the butt portion insert sidewall thickness (4050) is preferably at least 75% of the tip portion sidewall thickness (2050), and in yet a further embodiment the butt portion insert sidewall thickness (4050) is preferably at least 100% of the tip portion sidewall thickness (2050). In one embodiment the butt portion insert (4000) is formed of metallic material, while in another embodiment it is a metallic material different than that of the tip portion (2000), and in an even further embodiment it is formed of a metallic material having a density that is at least 35% less than the density of the tip portion (2000).

These relationships provide less twisting of the face, as well as improved consistency of the face velocity and acceleration of the heel and toe portions, both prior to, at, and after impact. FIG. 13(A) illustrates the velocity of the toe and heel of an Anser-style putter head attached to a traditional steel putter shaft attached to a robot, throughout a putting stroke with an off-center impact, while FIG. 14(A) illustrates the same putter head attached to an embodiment of the golf shaft (100). The crossing of the heel line and toe line of FIG. 13(A) shows the instability of the putter head, while FIG. 14(A) illustrates the improved performance exhibited by the golf shaft (100) whereby the heel line and toe line do not intersect.

Figure 13B:
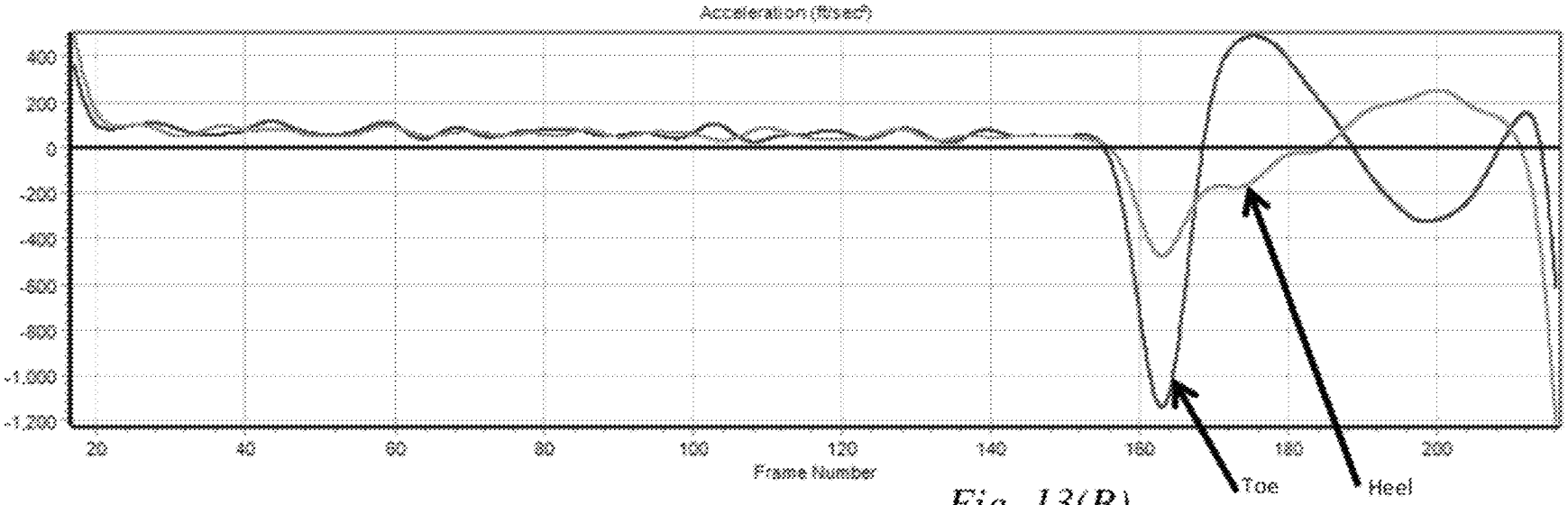
FIG. 13(B) shows a graph of the heel and toe acceleration of a putter head through a putting stroke, not to scale.
Figure 14A:
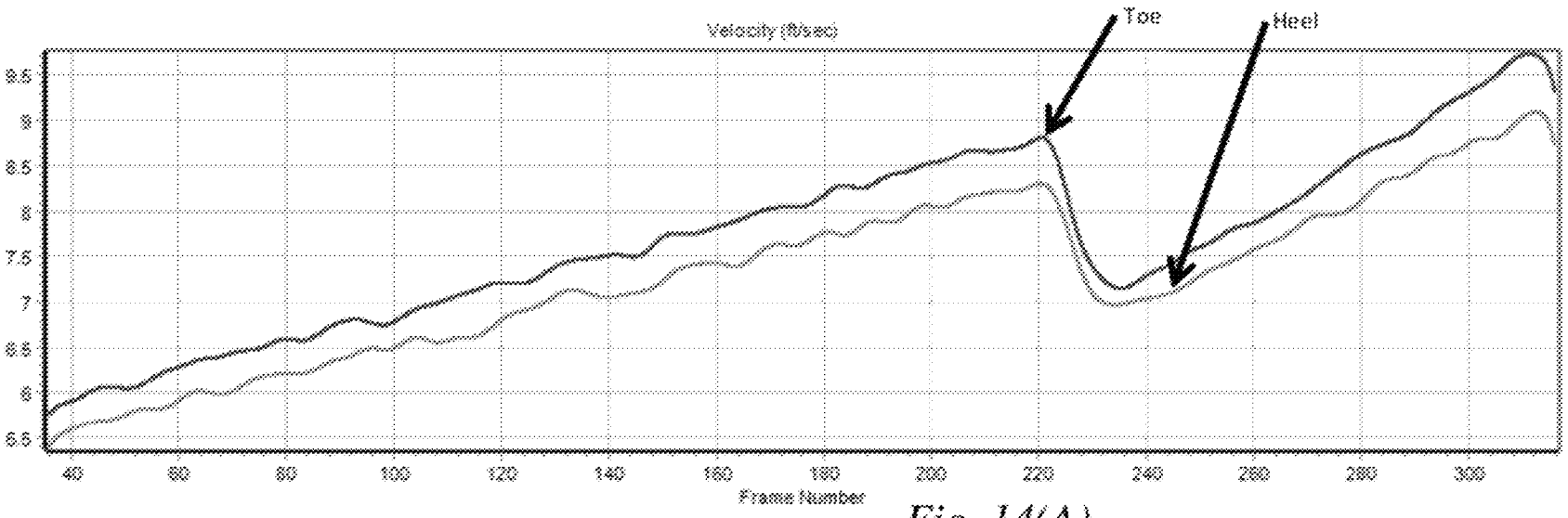
FIG. 14(A) shows a graph of the heel and toe velocity of a putter head through a putting stroke, not to scale.
Figure 14B:
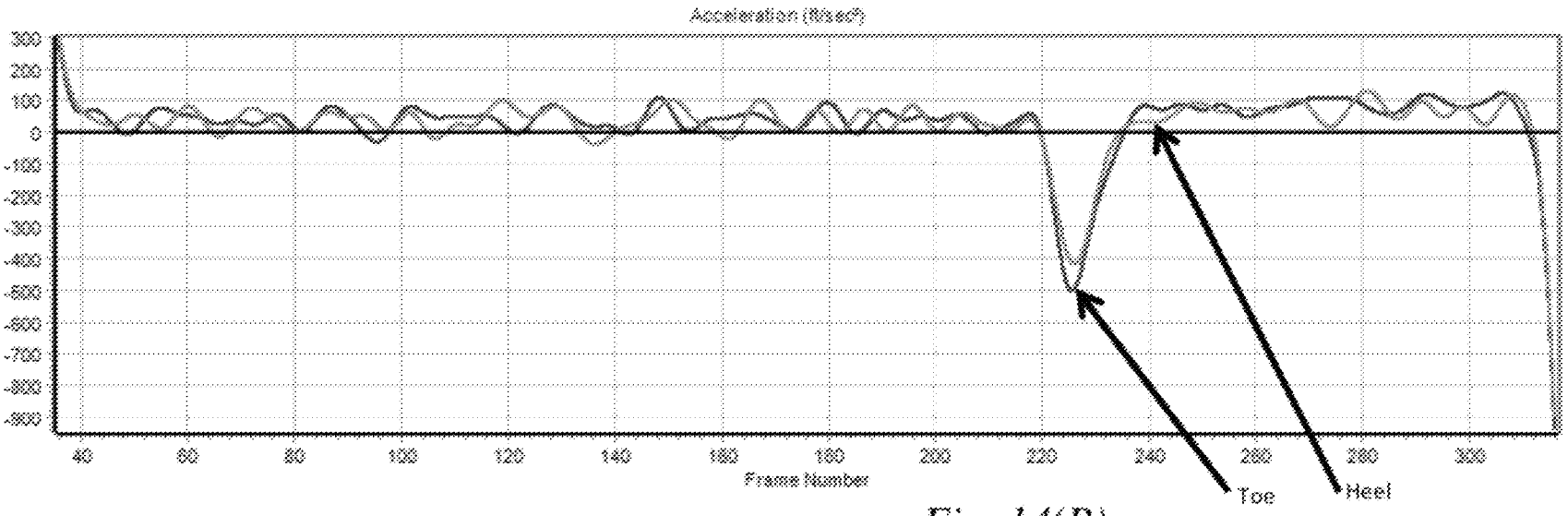
FIG. 14(B) shows a graph of the heel and toe acceleration of a putter head through a putting stroke, not to scale.

Likewise, FIG. 13(B) illustrates the acceleration of the toe and heel of the same Anser-style putter head attached to a traditional steel putter shaft attached to a robot, throughout a putting stroke with an off-center impact, while FIG. 14(B) illustrates the same putter head attached to an embodiment of the golf shaft (100). The differential between the heel line and toe line of FIG. 13(B) shows the instability of the putter head, while the differential of FIG. 14(B) illustrates the improved performance exhibited by the golf shaft (100) whereby the difference between heel line and toe line is significantly less. These improvements illustrate improved stability, which produces improved ball rolling characteristics, lower launch angles, and less dispersion. The relative volatility of the velocity and acceleration of the toe and heel of the club face pre-impact, at impact, and post-impact is significantly improved by these relationships, without a reduction in feel at and after impact.

Any of these embodiments may further enable the creation of a third portion of the reinforced region (2500) where the shaft flexural rigidity is greater than the shaft flexural rigidity in the first portion and less than the shaft flexural rigidity in the second portion, and shaft torsional rigidity is greater than the shaft torsional rigidity in the first portion and less than the shaft torsional rigidity in the second portion. In a further embodiment the third portion of the reinforced region (2500) has a shaft flexural rigidity that is at least 25% greater than the shaft flexural rigidity in the first portion and at least 25% less than the shaft flexural rigidity in the second portion, and a shaft torsional rigidity that is at least 25% greater than the shaft torsional rigidity in the first portion and at least 25% less than the shaft torsional rigidity in the second portion. In one embodiment the butt portion insert (4000) has a butt portion insert mass that is at least 10% of the shaft mass, while in another embodiment the butt portion insert mass is no more than 25% of the shaft mass.

In one embodiment the coupler (3000) is formed of a metallic coupler material having a coupler material density that is less than the tip portion material density, yet is at least 15% greater than the butt material density. In another embodiment the tip material density is at least 50% greater than the butt material density, while in a another embodiment the tip material density is at least twice the coupler material density, and in yet a further embodiment the tip material density is no more than six times the butt material density. In one particular embodiment the tip portion material density is at least 7 g/cc, the coupler material density is 2.5-5.0 g/cc, and the butt material density is no more than 2.4 g/cc. In a further embodiment the butt material density is no more than 2.0 g/cc, and no more than 1.8 g/cc in another embodiment, and no more than 1.6 g/cc in yet a further embodiment. The elastic modulus of the tip portion material is preferably at least 110 GPa and the shear modulus is preferably at least 40 GPa, while in another embodiment the elastic modulus of the tip portion material is at least 190 GPa and the shear modulus is at least 70 GPa. The elastic modulus of the coupler material is preferably at least 60 GPa and the shear modulus is preferably at least 20 GPa, while in another embodiment the elastic modulus of the coupler material is at least 110 GPa and the shear modulus is at least 40 GPa. The elastic modulus of the butt material is preferably at least 40 GPa and the shear modulus is preferably at least 15 GPa, while in another embodiment the elastic modulus of the butt material is at least 50 GPa and the shear modulus is at least 22.5 GPa. The materials may include a metal alloy (e.g., an alloy of titanium, an alloy of steel, an alloy of aluminum, and/or an alloy of magnesium), a composite material, such as a graphite composite, a ceramic material, fiber-reinforced composite, plastic, or any combination thereof.

Figure 8A:
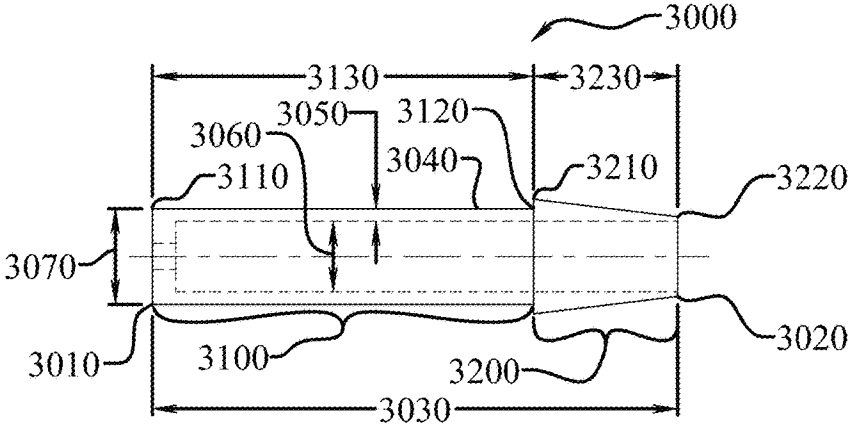
FIG. 8(A) shows a side elevation view of an embodiment of a coupler, not to scale.
Figure 8B:
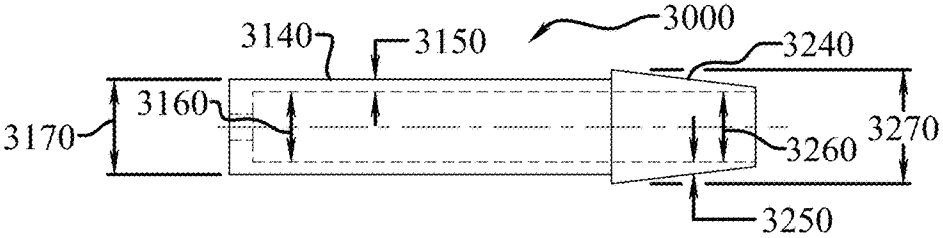
FIG. 8(B) shows a side elevation view of an embodiment of a coupler, not to scale.

As seen in FIGS. 8(A) and 8(B), the coupler (3000) may include a coupler-butt insert portion (3100) and coupler-tip receiving portion (3200), and in some embodiments they are separated by a change in the coupler outer diameter (3070) that forms a ledge having a ledge height that is no greater than the butt portion sidewall thickness (1050). The coupler-butt insert portion (3100) has a coupler-butt insert distal end (3110), a coupler-butt insert proximal end (3120), a coupler-butt insert length (3130) between the coupler-butt insert distal end (3110) and the coupler-butt insert proximal end (3120), a coupler-butt insert sidewall (3140), a coupler-butt insert sidewall thickness (3150), a coupler-butt insert inner diameter (3160), and a coupler-butt insert outer diameter (3170). Similarly, the coupler-tip receiver portion (3200) has a coupler-tip receiver distal end (3210), a coupler-tip receiver proximal end (3220), a coupler-tip receiver length (3230) between the coupler-tip receiver distal end (3210) and the coupler-tip receiver proximal end (3220), a coupler-tip receiver sidewall (3240), a coupler-tip receiver sidewall thickness (3250), and a coupler-tip receiver inner diameter (3260). In one embodiment the coupler-butt insert outer diameter (3170) no more than the butt portion inner diameter (1060), while in a further embodiment the coupler-tip receiver inner diameter (3260) is at least as great as the tip portion outer diameter (2070). The coupler-tip receiver length (3230) is preferably greater than the tip portion outer diameter (2070), and the coupler-butt insert length (3130) is preferably greater than the butt portion inner diameter (1060). In another embodiment the coupler-butt insert length (3130) is at least 50% greater than the coupler-tip receiver length (3230), and at least 75% greater in another embodiment, and at least 100% greater in yet a further embodiment. Alternatively, one skilled in the art will appreciate that the coupler (3000) may be configured in a reverse configuration where a portion of the butt portion (1000) is received within a portion the coupler (3000), and a portion of the coupler (3000) is received within a portion of the tip portion (2000); or in another embodiment a portion of the coupler (3000) is received within a portion of the butt portion (1000) and the tip portion (2000); or in yet a further embodiment both a portion of the butt portion (1000) and the tip portion (2000) are received within a portion of the coupler (3000).

The coupler sidewall thickness (3050) is preferably no more than the butt portion sidewall thickness (1050), and in one embodiment the coupler sidewall thickness (3050) is at least 10% less than the butt portion sidewall thickness (1050). In another embodiment a portion of the coupler sidewall (3040) has a coupler sidewall thickness (3050) that varies, and in a further embodiment it is the coupler-tip receiver sidewall thickness (3250) that varies, and in yet another embodiment the coupler-tip receiver sidewall thickness (3250) varies between a minimum and a maximum, wherein the maximum is at least 50% greater than the minimum. In another embodiment the maximum coupler-tip receiver sidewall thickness (3250) is at least 50% greater than the coupler-butt insert sidewall thickness (3150).

In the illustrated embodiment the tip portion (2000) extends all the way through the coupler-tip receiver portion (3200) and into the coupler-butt insert portion (3100) so that a cross-section through a portion of the overall shaft (100) includes an outer layer of the butt portion (1000), an intermediate layer of the coupler (3000), and an inner layer of the tip portion (2000), thereby achieving the relationships described herein. In another embodiment the tip portion distal end (2010) extends into the coupler-butt insert portion (3100) a first distance that is at least 50% of the butt portion outer diameter (1070), and at least 75% in another embodiment, and at least 100% in yet a further embodiment. A further series of embodiments limit the first distance to being no more than 50% of the tip portion length (2030) and no more than ten times the butt portion outer diameter (1070), while in another embodiment the first distance is no more than 35% of the tip portion length (2030) and no more than six times the butt portion outer diameter (1070), and in yet a further embodiment the first distance is no more than 25% of the tip portion length (2030) and no more than four times the butt portion outer diameter (1070). The embodiment of FIG. 8(A) includes an opening in the coupler distal end (3010) that permits the passage of air, which in one embodiment has an open area that is at least 10% of the area associated with the coupler outer diameter (3070), and at least 20% in another embodiment, and at least 30% in still a further embodiment.

Any of the disclosed embodiments of the shaft (100) may further be attached to a golf club head (5000), and include a grip (6000) attached to the shaft distal end (110) to create a fit-for-play golf club. As one skilled in the art will appreciate, the golf club may be a putter, a driver, a fairway wood, a hybrid or rescue, an iron, and/or a wedge. In one particular embodiment the golf club is a putter having a loft of less than 10 degrees, while in a further embodiment it is one having a club head weight of at least 310 grams, and yet another embodiment has a shaft length (130) of no more than 36". In another embodiment the club head weight is at least 320 grams, and at least 330 grams in a further embodiment, and at least 340 grams in still another embodiment.

The shaft (100) may be a putter shaft, wedge shaft, iron shaft, rescue shaft, fairway wood shaft, and/or driver shaft. In one particular putter shaft embodiment the shaft length (130) is no more than 38" and the shaft mass is at least 100 grams, while in another embodiment the shaft length (130) is no more than 36" and the shaft mass is 100-150 grams, and in yet a further embodiment the shaft length (130) is no more than 35" and the shaft mass is 110-140 grams. In one embodiment the tip portion (2000) is straight, while in a further embodiment directed to some putters the tip portion (2000) includes a double bend, which will be understood to one skilled in the art. One skilled in the art will appreciate that the overall shaft (100) will have a shaft center of gravity, or CG, the position of which may be referenced as a shaft CG distance from the shaft proximal end (120). In a putter embodiment having a shaft length (130) less than 35.5", the benefits described herein have been found to be heightened when the shaft CG distance is no more than 18", and no more than 17" in another embodiment, and no more than 16" in yet a further embodiment. Further, the benefits described herein have been found to be heightened when the shaft CG distance at least 9", and at least 11" in another embodiment, and at least 13" in yet a further embodiment. One particular embodiment has a shaft CG distance of 13-15.5". In further embodiments these shaft CG distances are further obtained with a shaft length (130) of no more than 35", and no more than 34" in another embodiment, and no more than 33" in yet a further embodiment. In even more embodiments the shaft CG distance is no more than 45% of the shaft length (130), and no more than 40% in another embodiment, and no more than 35% in yet a further embodiment. However, in another series of embodiments the shaft CG distance is at least 20% of the shaft length (130), and at least 25% in another embodiment, and at least 30% in still a further embodiment.

A typical tapered steel putter shaft having a length of 35" has a shaft CG distance that is approximately 20" and a kickpoint distance of approximately 14". The kickpoint distance of a golf shaft is determined by fixing the butt of the shaft, or the shaft distal end (110), and applying an axial compressive load on the tip of the shaft, or the shaft proximal end (120), until the distance between the two ends has changed by 0.5". Then a maximum deflection point is identified as the location of the maximum deflection from an initial shaft axis. The kickpoint distance is the distance measured along the initial shaft axis from the shaft proximal end (120) to the maximum deflection point.

Surprising performance benefits have been identified as the shaft CG distance is reduced, the kickpoint distance is increased, a combination thereof, or the difference between the shaft CG distance the kickpoint distance is reduced. In one embodiment of the present invention the kickpoint distance is at least 75% of the shaft CG distance, at least 85% in another embodiment, at least 95% in still a further embodiment, and at least 105% in yet another embodiment. In another series of embodiments the kickpoint distance is no more than 145% of the shaft CG distance, no more than 135% in another embodiment, no more than 125% in still a further embodiment, and no more than 115% in yet another embodiment. In one particularly effective embodiment the kickpoint distance is 85-135% of the shaft CG distance, 95-125% in another embodiment, and 100-115% in still a further embodiment. In another embodiment of the present invention the shaft CG distance is no more than 50% of the shaft length (130), no more than 47.5% in another embodiment, no more than 45% in a further embodiment, and no more than 42.5% in still another embodiment. In another series of embodiments the shaft CG distance is at least 30% of the shaft length (130), at least 35% in another embodiment, at least 37.5% in a further embodiment, and at least 40% in yet another embodiment.

A difference between the shaft CG distance and the kickpoint distance is preferably no more than 12.5% of the shaft length (130), no more than 10% in another embodiment, no more than 7.5% in still a further embodiment, and not more than 5% in yet another embodiment. In one particularly effective embodiment the difference between the shaft CG distance and the kickpoint distance is preferably no more than 4.5", no more than 3.5" in another embodiment, no more than 2.5" in a further embodiment, and no more than 1.5" in still another embodiment. In one embodiment the shaft CG distance is no more than 18.0", no more than 16.0" in another embodiment, no more than 15.5" in a further embodiment, and no more than 15.0" in yet another embodiment; all of which have a shaft length of 35.0".

In an embodiment the butt portion outer diameter (1070) is 0.500-0.700", while in another embodiment the butt portion outer diameter (1070) is 0.550-0.650", and in yet a further embodiment the butt portion outer diameter (1070) is 0.580-0.620". In another embodiment the tip portion outer diameter (2070) is 0.300-0.450", while in another embodiment the tip portion outer diameter (2070) is 0.330-0.420", and in yet a further embodiment the tip portion outer diameter (2070) is 0.350-0.390".

Any of the embodiments disclosed herein as having "a portion of" a first component with a first rigidity relative to "a portion of" a second component with a different second rigidity, include a further embodiment in which the relationship is true over at least 25% of the length of the first component and/or at least 25% of the length of the second component, or in another embodiment the relationship is true over at least 50% of the length of the first component and/or at least 50% of the length of the second component, and in yet a further embodiment the relationship is true over at least 75% of the length of the first component and/or at least 75% of the length of the second component.

Figure 9:
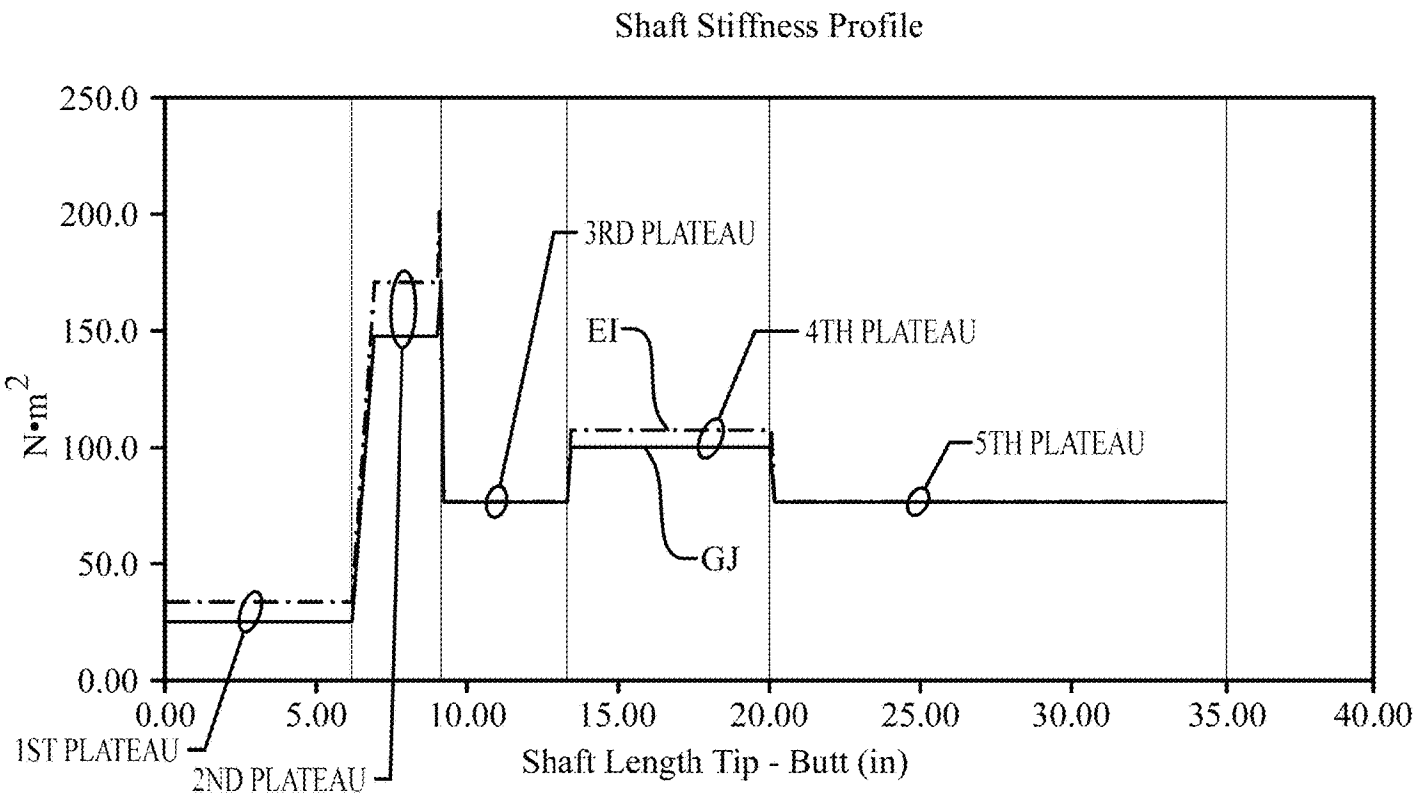
FIG. 9 shows a graph of the shaft stiffness profile of an embodiment of the golf shaft, not to scale.

Now returning to the shaft flexural rigidity, abbreviated EI, and the shaft torsional rigidity, abbreviated GJ, in the diagrams of FIGS. 9-12. As previously noted, the shaft flexural rigidity and the shaft torsional rigidity are that of cross-sections, perpendicular to the shaft axis, at points along the shaft length (100) and take into account areas of the shaft (100) composed of multiple elements within a particular cross-section, while in other areas the shaft (100) where there is no overlap of individual components the shaft rigidities are equal to the rigidities of the only component present in the cross-section at that particular location. With reference now specifically to FIG. 9, beginning at the left boundary of the diagram the shaft flexural rigidity, EI, and the shaft torsional rigidity, GJ, are constant, i.e. horizontal, along a first flexural rigidity plateau and a first torsional rigidity plateau through the portion of the shaft (100) that consists solely of the tip portion (2000), which has a constant cross-sectional profile in this embodiment. Then the shaft flexural rigidity increases along a first flexural rigidity ramp to a second flexural rigidity plateau, and the shaft torsional rigidity increases along a first torsional rigidity ramp to a second torsional rigidity plateau. In this embodiment the ramps begin where the tip portion (2000) enters the coupler-tip receiver portion (3200) of the coupler (3000), seen in FIG. 8(A), accounting for the overlap and the increasing coupler-tip receiver sidewall thickness (3250). In this embodiment the second flexural rigidity plateau and the second torsional rigidity plateau represent areas of constant rigidity because they are areas along the shaft length (130) including the butt portion (1000) overlapping the coupler-butt insert portion (3100) of the coupler (3000), which have constant cross-sectional profiles in this embodiment. In this embodiment the rigidities then drop to a third flexural rigidity plateau and a third torsional rigidity plateau in the area of the shaft (100) composed of only the butt portion (1000) within the separation distance (4080), seen in FIG. 4, which in this embodiment has a constant cross-sectional profile. In this embodiment the rigidities then increase to a fourth flexural rigidity plateau and a fourth torsional rigidity plateau in the area of the shaft (100) composed the butt portion (1000) and the butt portion insert (4000), seen in FIG. 4, both of which have constant cross-sectional profiles in this embodiment. In this embodiment the rigidities then decrease to a fifth flexural rigidity plateau and a fifth torsional rigidity plateau in the area of the shaft (100) composed solely of the butt portion (1000), which has a constant cross-sectional profile in this embodiment. In one embodiment the plateaus disclosed herein are not constant but have a slope, positive or negative, that is no more than 10 degrees, which is significantly less than the variations found in a conventional tapered or stepped shaft, such as the one illustrated in FIG. 12, while in another embodiment the slope is no more than 7.5 degrees, positive or negative, and is no more than 5.0 degrees, positive or negative, in still another embodiment, and is no more than 2.5 degrees, positive or negative, in yet a further embodiment.

As illustrated in the table of FIG. 9, an average second plateau flexural rigidity throughout the second plateau is at least twice an average first plateau flexural rigidity throughout the first plateau; and in a further embodiment the average second plateau flexural rigidity throughout the second plateau is at least 50% greater than an average third plateau flexural rigidity throughout the third plateau; and in a further embodiment the average second plateau flexural rigidity throughout the second plateau is at least 25% greater than an average fourth plateau flexural rigidity throughout the fourth plateau; and in yet still another embodiment the average second plateau flexural rigidity throughout the second plateau is at least 50% greater than an average fifth plateau flexural rigidity throughout the third plateau. Similarly, an average second plateau torsional rigidity throughout the second plateau is at least twice an average first plateau torsional rigidity throughout the first plateau; and in a further embodiment the average second plateau torsional rigidity throughout the second plateau is at least 50% greater than an average third plateau torsional rigidity throughout the third plateau; and in a further embodiment the average second plateau torsional rigidity throughout the second plateau is at least 25% greater than an average fourth plateau torsional rigidity throughout the fourth plateau; and in yet still another embodiment the average second plateau torsional rigidity throughout the second plateau is at least 50% greater than an average fifth plateau torsional rigidity throughout the third plateau.

In another embodiment an average fourth plateau flexural rigidity throughout the fourth plateau is at least 10% greater than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average fourth plateau torsional rigidity throughout the fourth plateau is at least 10% greater than at least one average plateau torsional rigidity of an adjacent plateau, while in one embodiment the adjacent plateau is located toward the shaft distal end (120), and in another embodiment the adjacent plateau is located toward the shaft proximal end (110).

In another embodiment an average third plateau flexural rigidity throughout the third plateau is at least 10% less than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average third plateau torsional rigidity throughout the third plateau is at least 10% less than at least one average plateau torsional rigidity of an adjacent plateau, while in one embodiment the adjacent plateau is located toward the shaft distal end (120), and in another embodiment the adjacent plateau is located toward the shaft proximal end (110).

In another embodiment an average second plateau flexural rigidity throughout the second plateau is at least 50% greater than at least one average plateau flexural rigidity of an adjacent plateau, while in one embodiment the adjacent plateau is located toward the shaft distal end (120), and in another embodiment the adjacent plateau is located toward the shaft proximal end (110). Similarly, in another embodiment an average second plateau torsional rigidity throughout the second plateau is at least 50% greater than at least one average plateau torsional rigidity of an adjacent plateau, while in one embodiment the adjacent plateau is located toward the shaft distal end (120), and in another embodiment the adjacent plateau is located toward the shaft proximal end (110).

In one embodiment the third plateau has a shaft flexural rigidity that is (a) at least 50% greater than the tip portion flexural rigidity, i.e. that of the first plateau, and (b) less than 100 $N*m^2$. Similarly, the third plateau has a shaft torsional rigidity that is (a) at least 50% greater than the tip portion torsional rigidity, i.e. that of the first plateau, and (b) less than 100 $N*m^2$. In another embodiment the second plateau has a shaft flexural rigidity is (a) at least 50% greater than the butt portion flexural rigidity, i.e. that of the third or fifth plateau, and (b) is greater than 120 $N*m^2$. Similarly, the second plateau has a shaft torsional rigidity that is (a) at least 50% greater than the butt portion torsional rigidity, i.e. that of the third or fifth plateau, and (b) is greater than 120 $N*m^2$.

In another embodiment a portion of the fourth plateau is within the reinforcement region (2500) and has a shaft flexural rigidity that is (a) greater than the shaft flexural rigidity of the third plateau, and (b) less than the shaft flexural rigidity of the second plateau. Likewise, in a further embodiment a portion of the fourth plateau is within the reinforcement region (2500) and has a shaft torsional rigidity that is (a) greater than the shaft torsional rigidity of the third plateau, and (b) less than the shaft torsional rigidity of the second plateau.

In another embodiment the shaft flexural rigidity profile and the shaft torsional rigidity profile each contain at least four distinct plateaus with each plateau having a length of at least 2", and at least one of the plateaus having a length of at least 6". In a further embodiment the shaft flexural rigidity profile and the shaft torsional rigidity profile each contain at least five distinct plateaus with each plateau having a length of at least 2", and at least two of the plateaus having a length of at least 6", and at least one of the plateaus having a length of at least 10".

Figure 12:
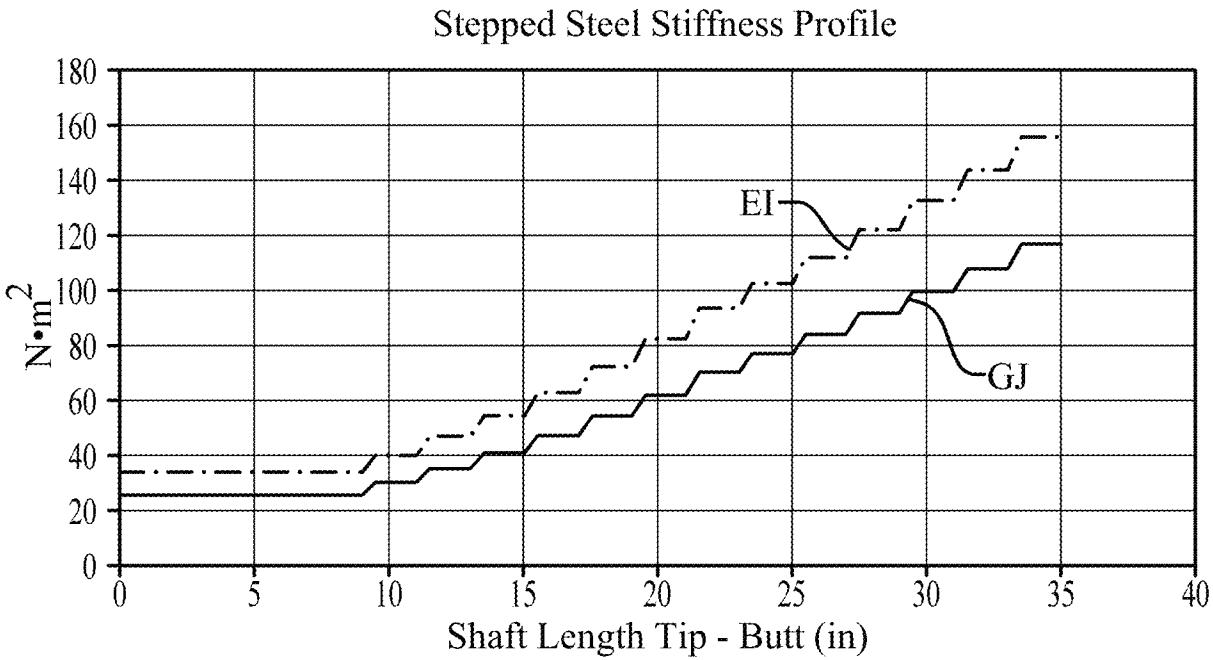
FIG. 12 shows a graph of the shaft stiffness profile of a conventional stepped steel golf shaft, not to scale.

In diagram (A) of FIG. 10 the shaft (100) is divided into a tip region and a butt region separated at the midpoint of the shaft length (130). Thus, the region from the midpoint to the shaft proximal end (120) is the tip region and the region from the midpoint to the shaft distal end (110) is the butt region. In one embodiment an average tip region flexural rigidity is within 25% of an average butt region flexural rigidity, while a conventional tapered or stepped shaft has an average tip region flexural rigidity that is less than 40% of an average butt region flexural rigidity, as seen in FIG. 12. In another embodiment the average tip region flexural rigidity is within 15% of an average butt region flexural rigidity, and within 10% in a further embodiment, and within 5% in yet another embodiment. In one particular embodiment the average tip region flexural rigidity is at least as great as the average butt region flexural rigidity. Similarly, in one embodiment an average tip region torsional rigidity is within 25% of an average butt region torsional rigidity, while a conventional tapered or stepped shaft has an average tip region torsional rigidity that is less than 40% of an average butt region torsional rigidity, as seen in FIG. 12. In another embodiment the average tip region torsional rigidity is within 15% of an average butt region torsional rigidity, and within 10% in a further embodiment, and within 5% in yet another embodiment.

In diagram (B) of FIG. 10 the shaft (100) is divided into a tip non-reinforced region, a reinforced region, and a butt non-reinforced region. All of the prior disclosure and embodiments of reinforced region (2500) are applicable to the reinforced region of FIG. 10. In a further embodiment the reinforced region (2500) has an average reinforced region flexural rigidity and an average reinforced region torsional rigidity, the tip non-reinforced region has an average tip non-reinforced region flexural rigidity and an average tip non-reinforced region torsional rigidity, and the butt non-reinforced region has an average butt non-reinforced region flexural rigidity and an average butt non-reinforced region torsional rigidity. An average of the average tip non-reinforced region flexural rigidity and the average butt non-reinforced region flexural rigidity is an average non-reinforced region flexural rigidity, and likewise an average of the average tip non-reinforced region torsional rigidity and the average butt non-reinforced region torsional rigidity is an average non-reinforced region torsional rigidity. In one embodiment the average reinforced region flexural rigidity is at least 50% greater than the average non-reinforced region flexural rigidity, and at least 60% greater in another embodiment, and at least 70% greater in a further embodiment. Similarly, in a further embodiment the average reinforced region torsional rigidity is at least 40% greater than the average non-reinforced region torsional rigidity, and at least 50% greater in another embodiment, and at least 60% greater in a further embodiment. In still another embodiment the average reinforced region flexural rigidity is 50-150% greater than the average non-reinforced region flexural rigidity, and 60-125% greater in another embodiment, and 65-100% greater in a further embodiment. Likewise, in a further embodiment the average reinforced region torsional rigidity is 40-120% greater than the average non-reinforced region torsional rigidity, and 50-110% greater in another embodiment, and 55-100% greater in a further embodiment.

In diagram (D) of FIG. 11 the shaft (100) is divided into a tip two-third region and a butt one-third based upon the shaft length (130). A first portion of the shaft (100) extending ⅔ of the shaft length (130) from the shaft proximal end (120), namely the tip two-third region, has a first average flexural rigidity, a second portion of the shaft (100) extending ⅓ of the shaft length (130) from the shaft distal end (110), namely the butt one-third region, has a second average flexural rigidity, and the first average flexural rigidity is at least 50% of the second average flexural rigidity. These relationships are significantly different that that found in a conventional tapered or stepped shaft where the tip two-third region has an average flexural rigidity that is less than 42% of the average flexural rigidity of the butt one-third region, as seen in FIG. 12. Similarly, the tip two-third region has a first average torsional rigidity, the butt one-third region has a second average torsional rigidity, and the first average torsional rigidity is at least 50% of the second average torsional rigidity. These relationships are significantly different that that found in a conventional tapered or stepped shaft where the tip two-third region has an average torsional rigidity that is less than 42% of the average torsional rigidity of the butt one-third region, as seen in FIG. 12. In another embodiment the first average flexural rigidity is at least 75% of the second average flexural rigidity. In a further related embodiment the first average flexural rigidity is at least 100% of the second average flexural rigidity, while in still another related embodiment the first average flexural rigidity is 75-200% of the second average flexural rigidity, and in yet another related embodiment the first average flexural rigidity is 100-150% of the second average flexural rigidity. In another embodiment the first average torsional rigidity is at least 75% of the second average torsional rigidity. In a further related embodiment the first average torsional rigidity is at least 100% of the second average torsional rigidity, while in still another related embodiment the first average torsional rigidity is 75-200% of the second average torsional rigidity, and in yet another related embodiment the first average torsional rigidity is 100-150% of the second average torsional rigidity.

In diagram (C) of FIG. 11 the shaft (100) is divided into a tip one-third region and a butt two-third based upon the shaft length (130). A first portion of the shaft (100) extending ⅓ of the shaft length (130) from the shaft proximal end (120), namely the tip one-third region, has a tip ⅓ average flexural rigidity, a second portion of the shaft (100) extending ⅔ of the shaft length (130) from the shaft distal end (110), namely the butt two-third region, has a butt ⅔ average flexural rigidity, and the tip ⅓ average flexural rigidity is at least 50% of the butt ⅔ average flexural rigidity. These relationships are significantly different that that found in a conventional tapered or stepped shaft where the tip one-third region has an average flexural rigidity that is less than 36% of the average flexural rigidity of the butt two-third region, as seen in FIG. 12. Similarly, the tip one-third region has a tip ⅓ average torsional rigidity, the butt two-third region has a butt ⅔ average torsional rigidity, and the tip ⅓ average torsional rigidity is at least 50% of the butt ⅔ average torsional rigidity. These relationships are significantly different that that found in a conventional tapered or stepped shaft where the tip one-third region has an average torsional rigidity that is less than 36% of the average torsional rigidity of the butt two-third region, as seen in FIG. 12. In another embodiment the tip ⅓ average flexural rigidity is at least 60% of the butt ⅔ average flexural rigidity. In a further related embodiment the tip ⅓ average flexural rigidity is at least 70% of the butt ⅔ average flexural rigidity, while in still another related embodiment the tip ⅓ average flexural rigidity is 60-120% of the butt ⅔ average flexural rigidity, and in yet another related embodiment the tip ⅓ average flexural rigidity is 70-110% of the butt ⅔ average flexural rigidity. In another embodiment the tip ⅓ average torsional rigidity is at least 60% of the butt ⅔ average torsional rigidity. In a further related embodiment the tip ⅓ average torsional rigidity is at least 70% of the butt ⅔ average torsional rigidity, while in still another related embodiment the tip ⅓ average torsional rigidity is 60-120% of the butt ⅔ average torsional rigidity, and in yet another related embodiment the tip ⅓ average torsional rigidity is 70-110% of the butt ⅔ average torsional rigidity.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A golf club shaft (100), comprising:

a shaft distal end (110), a shaft proximal end (120), a shaft outer diameter, a shaft length (130), and a shaft mass, wherein each point along the shaft length (130) has (i) a shaft flexural rigidity, and (ii) a shaft torsional rigidity;

the shaft (100) having a butt portion (1000) joined to a tip portion (2000), a shaft center of gravity located a shaft CG distance from the shaft proximal end (120), and a kickpoint located a kickpoint distance from the shaft proximal end (120);

the butt portion (1000) having a butt portion distal end (1010), a butt portion proximal end (1020), a butt portion length (1030), a butt portion sidewall (1040) having a butt portion sidewall thickness (1050), a butt portion inner diameter (1060), and a butt portion outer diameter (1070);

the tip portion (2000) having a tip portion distal end (2010), a tip portion proximal end (2020), a tip portion length (2030), a tip portion sidewall (2040) having a tip portion sidewall thickness (2050), a tip portion inner diameter (2060), and a tip portion outer diameter (2070);

the butt portion (1000) formed of a non-metallic butt portion material having a butt material density, a butt portion mass that is 35-75% of the shaft mass, a butt portion elastic modulus, a butt portion shear modulus, and each point along the butt portion length (1030) having (i) a butt portion area moment of inertia, (ii) a butt portion polar moment of inertia, (iii) a butt portion flexural rigidity, and (iv) a butt portion torsional rigidity;

the tip portion (2000) formed of a metallic tip portion material having a tip material density that is at least 15% greater than the butt material density, a tip portion elastic modulus, and a tip portion shear modulus, and each point along the tip portion length (2030) having (i) a tip portion area moment of inertia, (ii) a tip portion polar moment of inertia, (iii) a tip portion flexural rigidity, and (iv) a tip portion torsional rigidity, wherein the tip portion flexural rigidity of a portion of the tip portion (2000) is less than the butt portion flexural rigidity of a portion of the butt portion (1000);

wherein a first portion of the shaft (100) extending ⅔ of the shaft length (130) from the shaft proximal end (120) has a first average flexural rigidity and a first average torsional rigidity, a second portion of the shaft (100) extending ⅓ of the shaft length (130) from the shaft distal end (110) has a second average flexural rigidity and a second average torsional rigidity, the first average flexural rigidity is at least 50% of the second average flexural rigidity, and the first average torsional rigidity is within 25% of the second average torsional rigidity; and wherein a reinforced region (2500) is located between a first point located 5" from the shaft proximal end (120) and a second point located 24" from the shaft proximal end (120), and within the reinforced region (2500) (*a*) a portion of the shaft (100) has the shaft flexural rigidity at least 50% greater than a minimum tip portion flexural rigidity and less than 100 $N*m^2$, (b) a portion of the shaft (100) has the shaft torsional rigidity less than 100 $N*m^2$, (c) a portion of the shaft (100) has the shaft flexural rigidity at least 50% greater than a minimum butt portion flexural rigidity, and (d) a portion of the shaft (100) has the shaft torsional rigidity at least 50% greater than a minimum butt portion torsional rigidity.

2. The shaft (100) of claim 1, wherein the first average torsional rigidity is within 15% of the second average torsional rigidity.

3. The shaft (100) of claim 1, wherein the tip portion length (2030) is no more than 65% of the butt portion length (1030), a minimum tip portion flexural rigidity is at least 25% less than a minimum butt portion flexural rigidity, a minimum tip portion torsional rigidity is at least 25% less than a minimum butt portion torsional rigidity, and the tip portion outer diameter (2070) of a portion of the tip portion (2000) is at least 25% less than the butt portion outer diameter (1070) of a portion of the butt portion (1000).

4. The shaft (100) of claim 1, wherein the kickpoint distance is at least 75% of the shaft CG distance.

5. The shaft (100) of claim 4, wherein the kickpoint distance is 85-135% of the shaft CG distance, and the shaft CG distance is 35-45% of the shaft length (130).

6. The shaft (100) of claim 1, wherein the shaft flexural rigidity is constant throughout at least 10% of the shaft length (130), and the shaft torsional rigidity is constant throughout at least 10% of the shaft length (130).

7. The shaft (100) of claim 1, wherein the butt portion mass is 40-70% of the shaft mass, and the tip portion (2000) has a tip portion mass that is 35-85% of the butt portion mass.

8. The shaft (100) of claim 7, wherein the first average flexural rigidity is 75-200% of the second average flexural rigidity.

9. The shaft (100) of claim 7, wherein the butt portion mass is no more than 65 grams.

10. The shaft (100) of claim 1, wherein the shaft CG distance is 11-18".

11. The shaft (100) of claim 10, wherein the kickpoint distance is 85-135% of the shaft CG distance, and the shaft CG distance is no more than 50% of the shaft length (130).

12. The shaft (100) of claim 11, wherein the shaft CG distance is 35-45% of the shaft length (130).

13. The shaft (100) of claim 10, wherein a difference between the shaft CG distance and the kickpoint distance is no more than 12.5% of the shaft length (130).

14. The shaft (100) of claim 1, wherein (a) in a first portion of the shaft (100) the shaft flexural rigidity is constant for at least 2" and is at least 50% greater than a minimum tip portion flexural rigidity, and the shaft torsional rigidity is constant for at least 2" and is at least 50% greater than a minimum tip portion torsional rigidity, and (b) in a second portion of the shaft (100) the shaft flexural rigidity is constant for at least 2", and the shaft torsional rigidity is constant for at least 2".

15. A golf club shaft (100), comprising:

a shaft distal end (110), a shaft proximal end (120), a shaft outer diameter, a shaft length (130), and a shaft mass, wherein each point along the shaft length (130) has (i) a shaft flexural rigidity, and (ii) a shaft torsional rigidity;

the shaft (100) having a butt portion (1000) joined to a tip portion (2000), a shaft center of gravity located a shaft CG distance from the shaft proximal end (120) and is no more than 50% of the shaft length (130), and a kickpoint located a kickpoint distance from the shaft proximal end (120);

the butt portion (1000) having a butt portion distal end (1010), a butt portion proximal end (1020), a butt portion length (1030), a butt portion sidewall (1040) having a butt portion sidewall thickness (1050), a butt portion inner diameter (1060), and a butt portion outer diameter (1070);

the tip portion (2000) having a tip portion distal end (2010), a tip portion proximal end (2020), a tip portion length (2030), a tip portion sidewall (2040) having a tip portion sidewall thickness (2050), a tip portion inner diameter (2060), and a tip portion outer diameter (2070);

the butt portion (1000) formed of a non-metallic butt portion material having a butt material density, a butt portion mass that is 35-75% of the shaft mass, a butt portion elastic modulus, a butt portion shear modulus, and each point along the butt portion length (1030) having (i) a butt portion area moment of inertia, (ii) a butt portion polar moment of inertia, (iii) a butt portion flexural rigidity, and (iv) a butt portion torsional rigidity;

the tip portion (2000) formed of a metallic tip portion material having a tip material density that is at least 15% greater than the butt material density, a tip portion elastic modulus, and a tip portion shear modulus, and each point along the tip portion length (2030) having (i) a tip portion area moment of inertia, (ii) a tip portion polar moment of inertia, (iii) a tip portion flexural rigidity, and (iv) a tip portion torsional rigidity, wherein the tip portion flexural rigidity of a portion of the tip portion (2000) is less than the butt portion flexural rigidity of a portion of the butt portion (1000);

wherein a first portion of the shaft (100) extending ½ of the shaft length (130) from the shaft proximal end (120) has a first average flexural rigidity and a first average torsional rigidity, a second portion of the shaft (100) extending ½ of the shaft length (130) from the shaft distal end (110) has a second average flexural rigidity and a second average torsional rigidity, and the first average torsional rigidity is within 25% of the second average torsional rigidity; and wherein a reinforced region (2500) is located between a first point located 5" from the shaft proximal end (120) and a second point located 24" from the shaft proximal end (120), and within the reinforced region (2500) (*a*) a portion of the shaft (100) has the shaft flexural rigidity at least 50% greater than a minimum tip portion flexural rigidity and less than 100 $N*m^2$, (b) a portion of the shaft (100) has the shaft torsional rigidity less than 100 $N*m^2$, (c) a portion of the shaft (100) has the shaft flexural rigidity at least 50% greater than a minimum butt portion flexural rigidity, and (d) a portion of the shaft (100) has the shaft torsional rigidity at least 50% greater than a minimum butt portion torsional rigidity.

16. The shaft (100) of claim 15, wherein the tip portion (2000) has a tip portion mass that is 35-85% of the butt portion mass.

17. The shaft (100) of claim 15, wherein the tip portion length (2030) is no more than 65% of the butt portion length (1030), the tip portion outer diameter (2070) of a portion of the tip portion (2000) is at least 25% less than the butt portion outer diameter (1070) of a portion of the butt portion (1000), and the kickpoint distance is at least 75% of the shaft CG distance.

18. The shaft (100) of claim 17, wherein the shaft flexural rigidity is constant throughout at least 10% of the shaft length (130), and the shaft torsional rigidity is constant throughout at least 10% of the shaft length (130).

19. The shaft (100) of claim 17, wherein the first average torsional rigidity is within 15% of the second average torsional rigidity, the butt portion mass is no more than 65 grams, the shaft CG distance is 11-18", and the kickpoint distance is 85-135% of the shaft CG distance.

20. The shaft (100) of claim 15, wherein (a) in a first portion of the shaft (100) the shaft flexural rigidity is constant for at least 2" and is at least 50% greater than a minimum tip portion flexural rigidity, and the shaft torsional rigidity is constant for at least 2" and is at least 50% greater than a minimum tip portion torsional rigidity, and (b) in a second portion of the shaft (100) the shaft flexural rigidity is constant for at least 2", and the shaft torsional rigidity is constant for at least 2".

* * * * *